US011896084B2

(12) United States Patent
Howe

(10) Patent No.: US 11,896,084 B2
(45) Date of Patent: Feb. 13, 2024

(54) ARTICLE OF FOOTWEAR WITH COOLING FEATURES

(71) Applicant: Under Armour, Inc., Baltimore, MD (US)

(72) Inventor: Justin Howe, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 94 days.

(21) Appl. No.: 17/000,989

(22) Filed: Aug. 24, 2020

(65) Prior Publication Data

US 2020/0390185 A1 Dec. 17, 2020

Related U.S. Application Data

(63) Continuation of application No. 15/783,006, filed on Oct. 13, 2017, now Pat. No. 10,786,035.
(Continued)

(51) Int. Cl.
*A43B 7/00* (2006.01)
*A43B 13/12* (2006.01)
(Continued)

(52) U.S. Cl.
CPC ..... *A43B 7/005* (2013.01); *A43B 7/02* (2013.01); *A43B 7/081* (2013.01); *A43B 7/087* (2013.01);
(Continued)

(58) Field of Classification Search
CPC ..... A43B 7/005; A43B 7/06; A43B 7/087; A43B 7/081; A43B 7/085; A43B 7/1405;
(Continued)

(56) References Cited

U.S. PATENT DOCUMENTS 1,352,731 A * 9/1920 Egerton ..... A43B 13/223 36/59 B
2,292,318 A 8/1942 Daly
(Continued)

FOREIGN PATENT DOCUMENTS

EP 2446763 A1 5/2012
EP 1955607 B2 9/2012
(Continued)

*Primary Examiner* — Patrick J. Lynch

(74) *Attorney, Agent, or Firm* — Edell, Shapiro & Finnan, LLC

(57) ABSTRACT

The present invention is directed toward an article of footwear effective to regulate the temperature of the feet of a wearer. In an embodiment, the article of footwear includes an upper and an insole with a thermal effect membrane. The thermal effect membrane contains a plurality of system-reactive components selectively engaged heat and/or moisture. In an embodiment, the printed coating includes a cooling agent, a phase change material, and a heat dissipation material. The bottom of the sole structure of the article of footwear further includes a multiple openings in the forefoot, midfoot, and hindfoot regions. The multiple openings promote airflow into the interior of the upper. In operation, the article of footwear is effective to delay/diminish the rise in skin temperature (compared to footwear lacking the membrane and/or openings), increasing wearer comfort.

21 Claims, 18 Drawing Sheets

Related U.S. Application Data

(60) Provisional application No. 62/407,789, filed on Oct. 13, 2016.

(51) Int. Cl.

| | |
|---|---|
| ***A43B 7/08*** | (2022.01) |
| ***A43B 23/02*** | (2006.01) |
| ***A43B 7/02*** | (2022.01) |
| ***A43B 13/18*** | (2006.01) |

(52) U.S. Cl.
CPC ..... *A43B 13/127* (2013.01); *A43B 13/188* (2013.01); *A43B 23/0205* (2013.01); *A43B 23/027* (2013.01)

(58) Field of Classification Search
CPC ..... A43B 5/0405; A43B 13/12; A43B 13/125; A43B 13/127; B01D 46/0038
See application file for complete search history.

(56) References Cited

U.S. PATENT DOCUMENTS

| | | | | |
|---|---|---|---|---|
| 3,050,875 | A | 8/1962 | Robbins | |
| 3,225,463 | A | 12/1965 | Burnham | |
| 3,418,731 | A | 12/1968 | Anciaux | |
| 3,624,930 | A | 12/1971 | Johnson et al. | |
| 3,812,604 | A * | 5/1974 | Sato | A43B 9/18 12/142 RS |
| 4,078,321 | A | 3/1978 | Famolare, Jr. | |
| 4,364,186 | A | 12/1982 | Fukuoka | |
| 4,438,573 | A | 3/1984 | McBarron | |
| 4,617,745 | A | 10/1986 | Batra | |
| 4,910,882 | A | 3/1990 | Göller | |
| 5,619,809 | A | 4/1997 | Sessa | |
| 6,041,519 | A | 3/2000 | Cheng | |
| 6,247,248 | B1 | 6/2001 | Clark | |
| 6,305,100 | B1 | 10/2001 | Komarnycky et al. | |
| 6,401,364 | B1 | 6/2002 | Burt | |
| 6,553,690 | B2 | 4/2003 | Di Girolamo | |
| 6,817,112 | B2 | 11/2004 | Berger et al. | |
| 6,892,478 | B1 | 5/2005 | Erickson et al. | |
| 7,210,248 | B2 | 5/2007 | Van Noy et | |
| 7,328,524 | B2 | 2/2008 | Lebo | |
| 7,487,602 | B2 | 2/2009 | Berger et al. | |
| 7,673,399 | B2 | 3/2010 | Garcia-Perez Aradros | |
| 7,712,229 | B2 | 5/2010 | Yang | |
| 7,716,852 | B2 | 5/2010 | Berger et al. | |
| 7,818,896 | B2 | 10/2010 | Hsieh et al. | |
| 7,913,421 | B2 | 3/2011 | Malenotti | |
| 8,191,284 | B2 | 6/2012 | Cho | |
| 8,209,882 | B2 | 7/2012 | Leimer et al. | |
| 8,327,559 | B2 | 12/2012 | Berger et al. | |
| 8,919,011 | B2 | 12/2014 | Byrne | |
| 9,119,440 | B2 | 9/2015 | Lagneau et al. | |
| 9,192,208 | B2 | 11/2015 | Peikert et al. | |
| 9,232,830 | B2 | 1/2016 | Davis et al. | |
| 10,588,376 | B1 * | 3/2020 | Li | A43B 13/12 |
| 2002/0157278 | A1 * | 10/2002 | Moretti | A43B 7/06 36/3 R |
| 2004/0035025 | A1 | 2/2004 | Choi | |
| 2006/0277787 | A1 | 12/2006 | Vattes et al. | |
| 2006/0283043 | A1 | 12/2006 | Lamstein | |
| 2009/0188134 | A1 * | 7/2009 | Polegato Moretti | A43B 7/32 36/30 R |
| 2010/0024255 | A1 | 2/2010 | Oumnia | |
| 2012/0015155 | A1 | 1/2012 | Blackford et al. | |
| 2012/0151804 | A1 * | 6/2012 | Polegato Moretti | B29D 35/142 36/43 |
| 2012/0266494 | A1 | 10/2012 | Ko et al. | |
| 2012/0266497 | A1 | 10/2012 | Kosta | |
| 2013/0025157 | A1 * | 1/2013 | Wan | A43B 7/06 36/45 |
| 2013/0239442 | A1 * | 9/2013 | Plegato Moretti | A43B 7/06 36/3 A |
| 2013/0239444 | A1 | 9/2013 | Polegato Moretti | |
| 2014/0352178 | A1 | 12/2014 | Bruce et al. | |
| 2015/0106992 | A1 | 4/2015 | Blakely et al. | |
| 2015/0208758 | A1 | 7/2015 | Williams, Sr. | |
| 2015/0257475 | A1 | 9/2015 | Langvin et al. | |
| 2016/0010274 | A1 | 1/2016 | Jarre et al. | |
| 2016/0015122 | A1 * | 1/2016 | Nishiwaki | A43B 13/42 36/30 R |
| 2016/0120260 | A1 * | 5/2016 | Hansen | A43B 7/08 12/146 B |
| 2016/0120262 | A1 | 5/2016 | Cortez et al. | |
| 2016/0213090 | A1 | 7/2016 | Nakano | |
| 2017/0145596 | A1 | 5/2017 | Hays et al. | |
| 2018/0035756 | A1 * | 2/2018 | Lin | B32B 5/26 |
| 2018/0127617 | A1 | 5/2018 | Kabagambe et al. | |
| 2018/0228246 | A1 * | 8/2018 | Polegato Moretti | A43B 23/0215 |
| 2021/0037911 | A1 * | 2/2021 | Paulson | A43B 13/127 |

FOREIGN PATENT DOCUMENTS

| | | |
|---|---|---|
| EP | 2438825 B1 | 5/2014 |
| WO | 9628054 A1 | 9/1996 |

* cited by examiner

ARTICLE OF FOOTWEAR WITH COOLING FEATURES

CROSS-REFERENCE TO RELATED APPLICATIONS

This application is a continuation of U.S. application Ser. No. 15/783,006, entitled "Article of Footwear with Cooling Features," and filed on Oct. 13, 2017, which claims priority under 35 U.S.C. 119(e) to U.S. Provisional Patent Application Ser. No. 62/407,789, entitled "Article of Footwear with Cooling Features," filed Oct. 13, 2016, the disclosures of which are incorporated herein by reference in their entirety for all purposes.

FIELD OF THE INVENTION

The present invention relates to an article of footwear with one or more cooling features.

BACKGROUND OF THE INVENTION

Athletes generate heat as a result of physical activity—skin and/or body temperature rise during sustained physical exertion. In footwear, this heat becomes trapped within the foot cavity. Failure to properly move heat away from the feet and out of the foot cavity may lead to "overheating," creating not only discomfort, but also increasing the potential risk for adverse health consequences such as swelling, excessive sweating, and the development of blisters.

Accordingly, it would be desirable to provide an article of footwear effective to cool and/or temper the increase in the temperature of the foot cavity within the article of footwear.

SUMMARY OF THE INVENTION

The present invention is directed toward an article of footwear configured to moderate and/or modulate the temperature of the foot cavity and/or the foot (e.g., the skin temperature of the foot). In an embodiment, the interior surface of the upper includes a thermal effect layer configured to interact with heat and/or moisture within the foot cavity. In an embodiment, the thermal effect layer includes a plurality of system-reactive components that are selectively activated as heat and/or moisture within the foot cavity reaches predetermined levels.

In addition, the article of footwear may be configured to promote air exchange between the foot cavity and the ambient environment. In an embodiment, the sole structure includes one or more apertures or vents disposed at selected locations along the sole structure. By way of example, the apertures may be disposed in each of the forefoot, midfoot, and hindfoot regions of the article of footwear. In operation, the article of apparel is effective to delay/diminish the rise in skin temperature (compared to an article of footwear lacking the membrane and/or plurality of openings) and/or improve the overall moisture management capacity of the substrate, either of which may improve wearer comfort.

BRIEF DESCRIPTION OF THE DRAWINGS

Like reference numerals have been used to identify like elements throughout this disclosure.

DETAILED DESCRIPTION OF THE INVENTION

Figure 1:
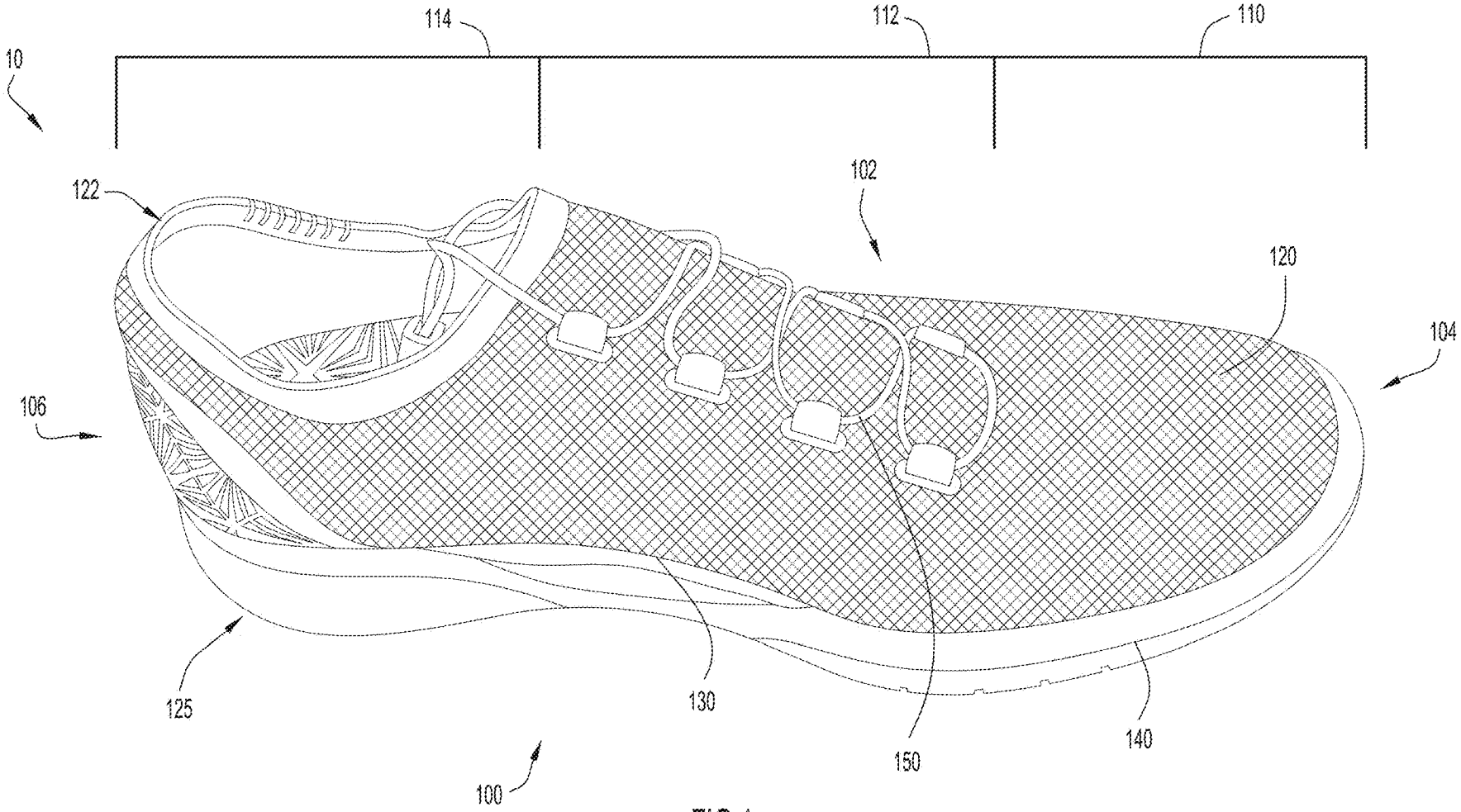
FIG. 1 illustrates a perspective view of an embodiment of an article of footwear according to the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

An article of footwear or shoe 10 includes a medial side 100 oriented along the medial or big toe side of the user's foot, a lateral side 102 oriented along the lateral or little toe side of the user's foot, a toe (i.e., front) end 104 that corresponds with the toes of the user's foot, and a heel (i.e., rear) end 106 that corresponds with the heel of the user's foot. While the example embodiment depicted in the FIGS. 1-4, 5A, 7A, 8A, 9A, 10A, 10B, and 10C shows an article of footwear 10 configured for a left foot, it is noted that the same or similar features can also be provided for an article of footwear 10 configured for a right foot (where such features of the right footed article of footwear are a reflection or "mirror image" symmetrical in relation to the left footed article of footwear, e.g., the embodiment depicted in FIGS. 1-4, 5A, 7A, 8A, 9A, 10A, 10B, and 10C). Furthermore, the example embodiment depicted in FIGS. 5B, 6, 7B, 8B, and 9B is a sole structure for an article of footwear 10 configured for a right foot. Thus, the sole structure depicted in FIGS. 5B, 6, 7B, 8B, and 9B is a mirror image of the sole structure of the article of footwear 10 depicted in FIGS. 1-4, 5A, 7A, 8A, 9A, 10A, 10B, and 10C. It then follows that the discussion of FIGS. 1-4, 5A, 7A, 8A, 9A, 10A, 10B, and 10C applies to the sole structure illustrated in 5B, 6, 7B, 8B, and 9B of the article of footwear 10, and vice versa.

The article of footwear 10 may include a forefoot region 110 that generally aligns with the ball and toes of a user's foot (i.e., when a user is wearing the article of footwear 10), a midfoot region 112 that generally aligns with the arch and instep areas of the user's foot, and a hindfoot region 114 that generally aligns with the heel and ankle areas of the user's foot. The embodiment of the article of footwear 10 illustrated includes an upper 120, a sole structure 125, and a fastening element 150. The article of footwear 10 illustrated in FIGS. 1-4, 5A, 5B, 6, 7A, 7B, 8A, 8B, 9A, 9B, 10A, 10B, and 10C may be utilized and applied for any type of article of footwear, including, but not limited to, shoes, sneakers, boots, sandals, etc.

The sole structure 125 includes a first midsole 130 mounted on top of a second midsole 140, and an outsole 145 disposed on the bottom of the second midsole 140.

Figure 2:
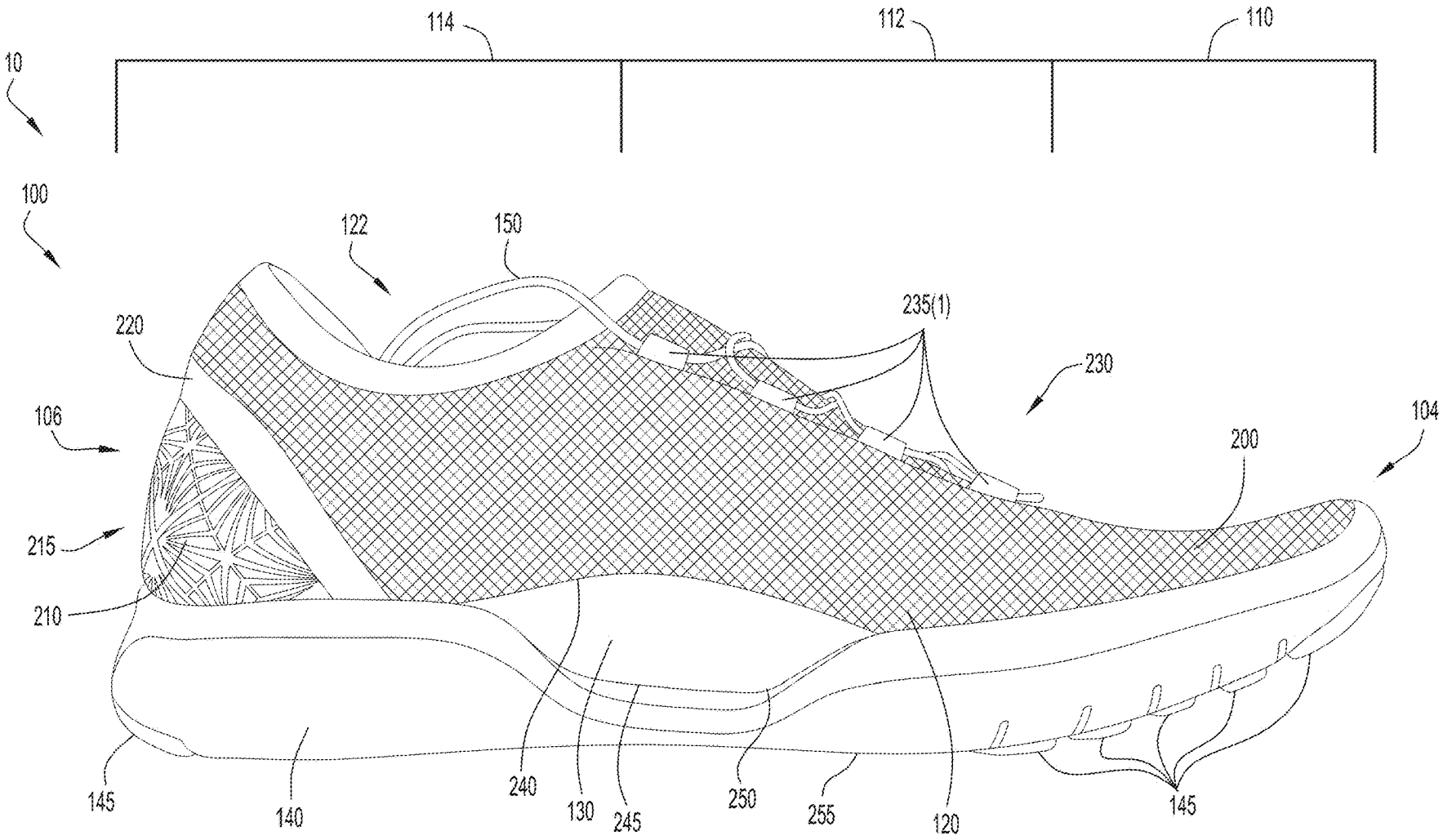
FIG. 2 illustrates a side elevational view of the medial side of the embodiment of the article of footwear illustrated in FIG. 1.
Figure 3:
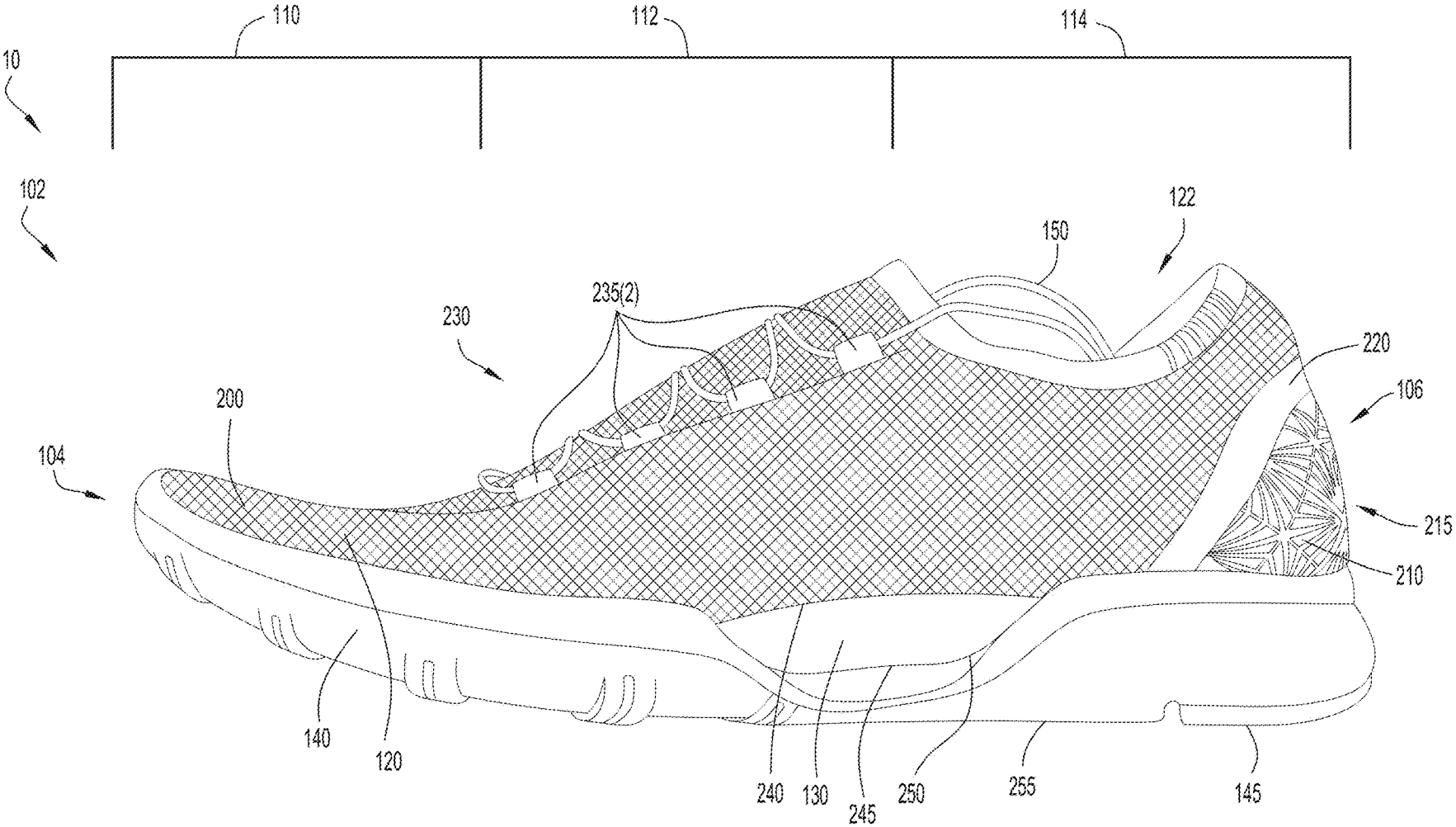
FIG. 3 illustrates a side elevational view of the lateral side of the embodiment of the article of footwear illustrated in FIG. 1.

The upper 120 forms an envelope or pocket that, in cooperation with the sole structure 125 defines a foot cavity operable to house (cover and protect) the foot of the wearer of the article of footwear 10. The upper 120 may include a first portion 200 and a second portion 210. The first portion 200 of the upper 120 may span from the toe end 104 to the heel end 106, or, in other words, may be disposed in the forefoot 110, midfoot 112, and hindfoot 114 regions of the article of footwear 10. However, the first portion 200 of the upper 120 may not be disposed in the heel end 106 proximate to the first and second midsoles 130, 140. The second portion 210 may only be disposed proximate to the heel end 106, and within the hindfoot region 114 of the article of footwear 10, and proximate to the first and second midsoles 130, 140. Thus, as illustrated in FIGS. 2 and 3, the second portion 210 of the upper 120 forms a heel cup portion of the upper 120. In some embodiments, the second portion 210 of the upper 120 may contain an internal heel counter. Furthermore, the first portion 200 of the upper 120 and the second portion 210 of the upper may be coupled to one another via a seam and/or seam tape 220. As illustrated, the upper 120 includes a lateral quarter, a medial quarter, a vamp, a toe cage, and a heel, where the heel is formed by both the first portion 200 and the second portion 210. In the illustrated embodiment, the vamp possesses a unitary construction, being integrated with the medial and lateral quarters to form a tongue-less upper 120 construction. In other embodiments, however, the vamp may include a tongue slot dividing the medial and lateral quarters with a tongue coupled to the rear of the vamp.

The first portion 200 and the second portion 210 of the upper 120 may be constructed from various materials that are configured to conform and contour to a foot that is placed within the article of footwear 10. In some embodiments, various materials may be used to construct the upper 120, including, but not limited to, leather, synthetic leather, rubber, textile fabrics (e.g., breathable fabrics, mesh fabrics, synthetic fabrics), etc. One material used for the upper 120 may be configured to have a high degree of stretchability and compressibility, while another material used on the upper 120 may have a lower degree of stretchability and compressibility. The materials used on the upper 120 maybe generally lightweight and flexible, and may be configured to provide comfort to the user and provide other desirable features. The materials used on the upper 120 may be configured to have desirable aesthetics and functional features that incorporate durability, flexibility, air permeability and/or other types of desirable properties to the upper 120.

Figure 4:
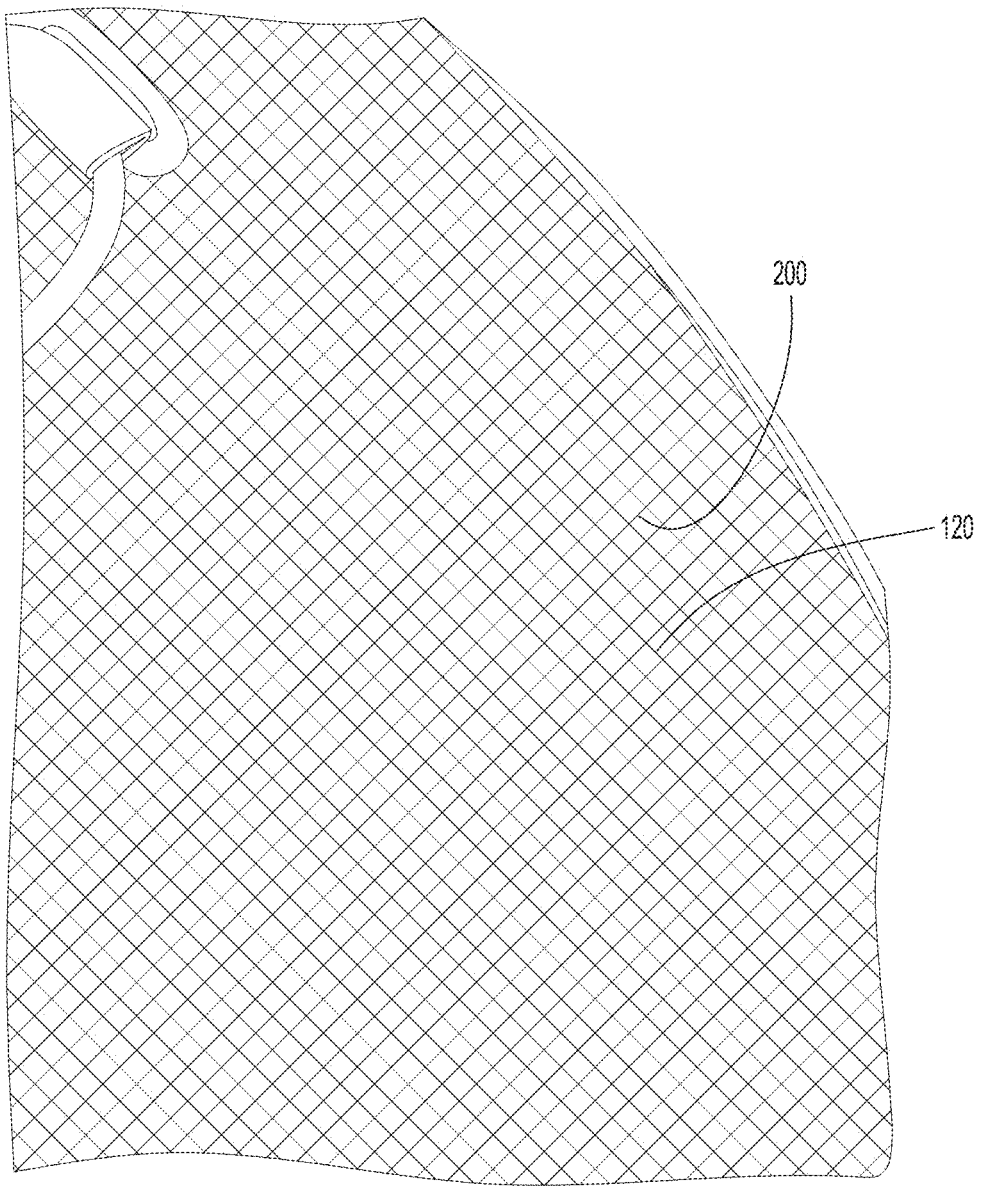
FIG. 4 illustrates a detailed view of the upper of the embodiment of the article of footwear illustrated in FIG. 1.

As illustrated in FIG. 4, the example embodiment of the first portion 200 of the upper 120 is formed of a high porosity material operable to permit the flow of fluid (e.g., air) therethrough. Specifically, the first portion material may include an outer shell layer and inner lining or substrate facing the foot cavity. The outer shell possesses an open web structure and includes a framework that defines negative spaces or apertures. In an embodiment, the outer shell is a mesh fabric. A mesh fabric is a woven, nonwoven, knit, or embroidered textile characterized by open spaces between the yarns. The interior lining defines a continuous surface operable to receive the temperature modulating membrane. In an embodiment, the interior lining is a lightweight, breathable knit textile.

The second portion material may be a low porosity material operable to stabilize the heel during use. In an embodiment, the second portion is a laminate including an outer textile layer, an intermediate reinforcing layer (e.g., a nonporous film of polyurethane), and an interior textile layer. By way of example, the second portion material is generally nonporous and nonbreathable.

As further illustrated, a collar or opening 122 may be disposed in the hindfoot region 114 of the first portion 200 of the upper 120. As further detailed below, the opening 122 provides access to the interior 1000 of the upper 120 and enables a foot of a wearer of the article of footwear 10 to be placed within the interior 1000 of the upper 120.

Eyelets 230 extend from the first portion 200 of the upper 120 forward of the opening 122 in the midfoot region 112 of the upper 120. The eyelets 230 may be in the form of loops that extend from the first portion 200 of the upper 120. The eyelets 230 may include a medial set of eyelets 235(1) and a lateral set of eyelets 235(2). The medial set of eyelets 235(1) may be disposed along the midfoot region 112 of the upper 120 proximate to the medial side 100 of the article of footwear 10, and the lateral set of eyelets 235(2) may be disposed along the midfoot region 112 of the upper 120 proximate to the lateral side 102 of the article of footwear 10. The medial set of eyelets 235(1) may be aligned in the lengthwise direction of the article of footwear 10 on the medial side 100 of the upper 120. Similarly, the lateral set of eyelets 235(2) may be aligned in the lengthwise direction of the article of footwear 10, but on the lateral side 102 of the upper 120. As illustrated, both the medial set of eyelets 235(1) and the lateral set of eyelets 235(2) include four (4) individual eyelets. Furthermore, each of the medial set of eyelets 235(1) is aligned with one of the lateral set of eyelets 235(2) along the widthwise direction of the article of footwear 10. A fastening element or fastener 150 (e.g., a lace, cord, string, etc.) may be threaded through each of the eyelets 230 on the upper 120.

As further illustrated in FIGS. 2 and 3, the first midsole 130 includes a top surface 240 and a bottom surface 245, while the second midsole 140 includes a top surface 250 and a bottom surface 255. When viewing the article of footwear 10 from above or viewing the medial and lateral sides 100, 102, the first midsole 130 is only visible within the midfoot region 112 of the article of footwear 10. As explained in further detail below, the bottom surface 245 of the first midsole 130 sits on and is coupled to the top surface 250 of the second midsole 140 such that the first midsole 130 rests primarily within the second midsole 140. The upper 120, including both the first portion 200 and the second portion 210 is placed on and is coupled to the top surface 240 of the first midsole 130. In some embodiments, the upper 120 may be at least partially coupled to the edges of the top surface 250 of the second midsole 140. The bottom surface 255 of the second midsole 140 is configured to contact a support surface.

As illustrated, the second midsole 140 is thinnest (i.e., the distance between the top surface 250 and the bottom surface 255) in the midfoot region 112 on both the medial side 100 and the lateral side 102 of the article of footwear 10. More specifically, the second midsole 140 is thinnest proximate to where the arch of a foot disposed within the upper 120 would be located. As further illustrated, the first midsole 130 extends upward along the upper 120 in the midfoot region 112 of the article of footwear 10 on both the medial side 100 and the lateral side 102. Thus, the first midsole 130 is configured to provide arch support to a foot disposed within the upper 120, but may be configured to still flex and/or bend when imparted with enough pressure/force.

The first midsole 130 may be formed of a compression material such as a foamed elastomer, e.g., an ethylene-vinyl acetate (EVA) foam. In the embodiment illustrated, the foam possesses a durometer value (on a type C scale) of approximately 45C (with a variance of ±3C). In other embodiments of the article of footwear 10, the first midsole 130 may have durometer value that is greater or lesser than 45C.

The second midsole 140 may also be formed from a compression material such as a foamed elastomer, e.g., an ethylene-vinyl acetate (EVA) foam. In the embodiment illustrated, however, the foam possesses a durometer value (on a type C scale) of approximately 55C with a variance of ±3C. In other embodiments of the article of footwear 10, the second midsole 140 may have durometer value that is greater or lesser than 55C. Accordingly, the compression material of the second midsole 140 possesses a higher durometer value than the compression material of the first midsole 130.

Figure 5A:
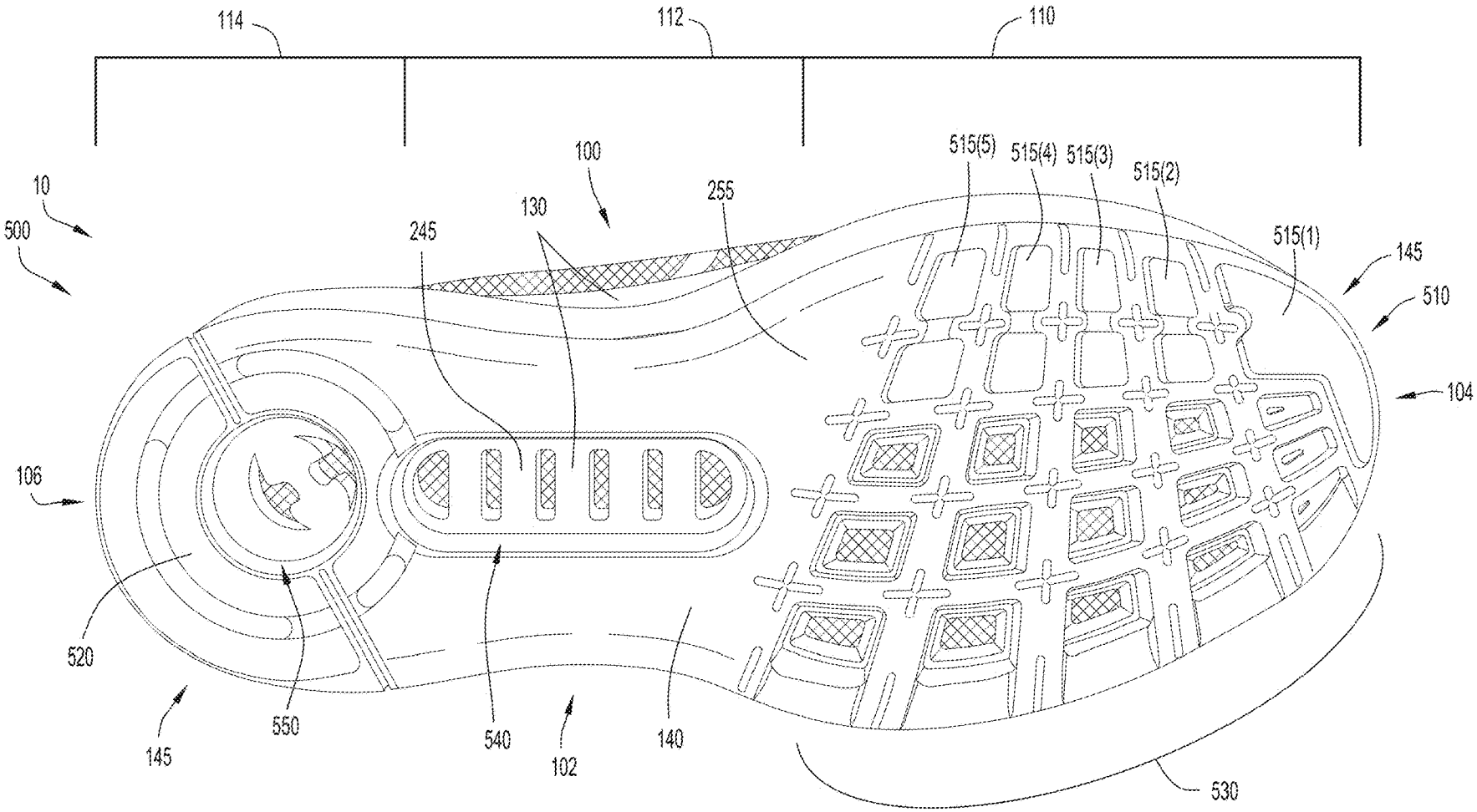
FIG. 5A illustrates a bottom view of the embodiment of the article of footwear illustrated in FIG. 1.
Figure 5B:
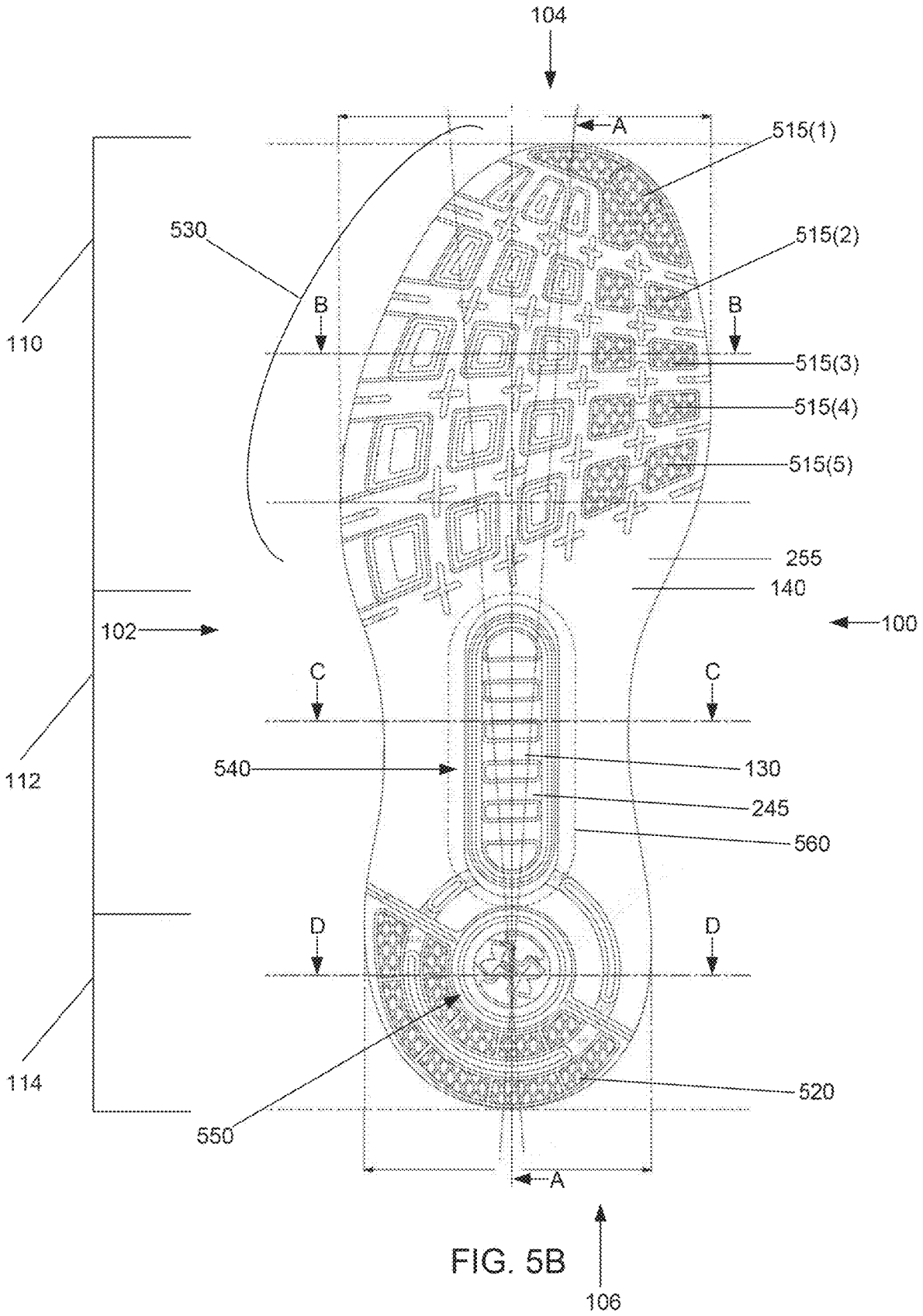
FIG. 5B illustrates another bottom view of the embodiment of the article of footwear illustrated in FIG. 1.
Figure 6:
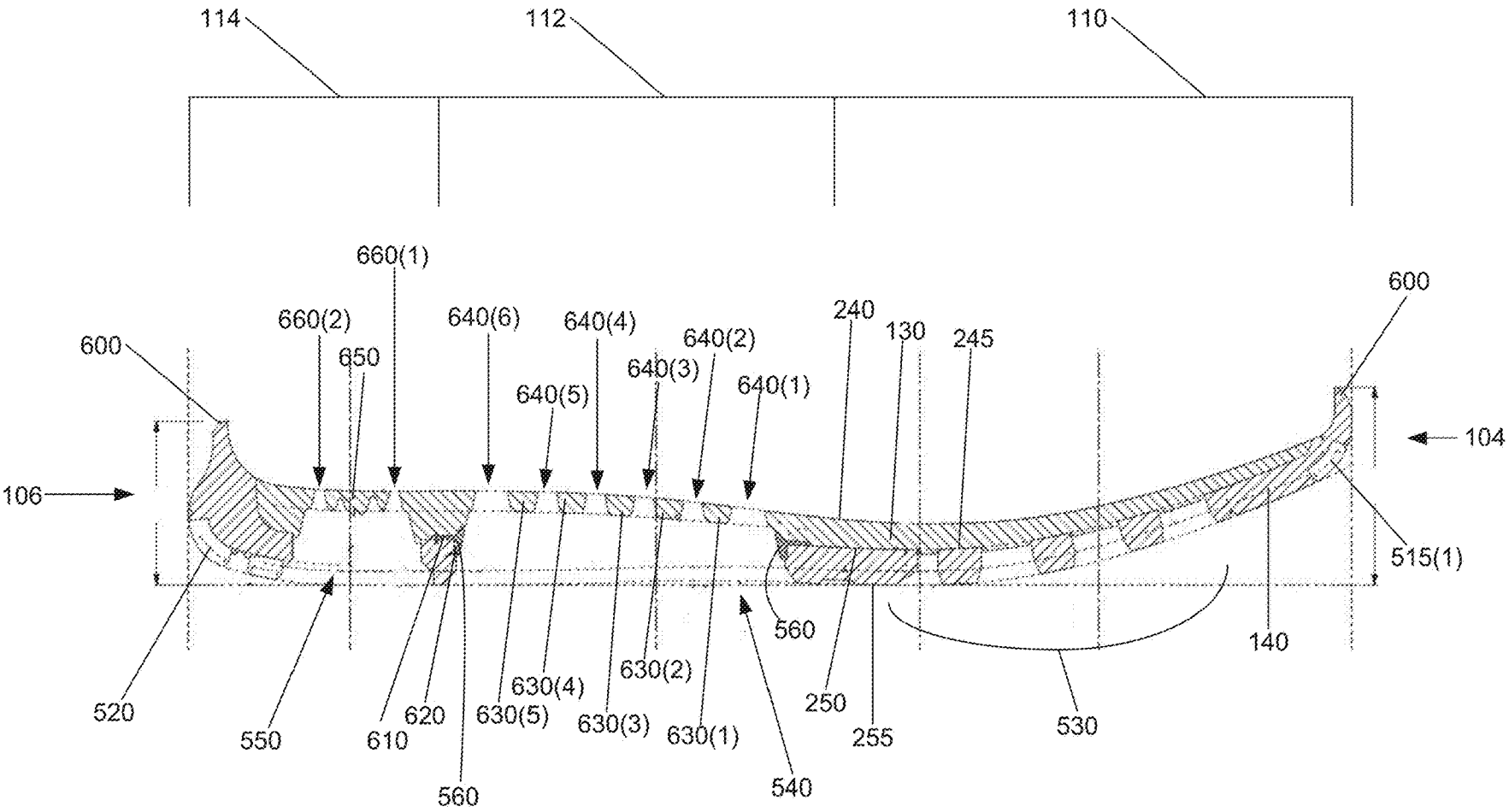
FIG. 6 illustrates a cross sectional view along line A-A of FIG. 5B of the sole structure of the embodiment of the article of footwear illustrated in FIG. 1.

As best illustrated in FIGS. 5A and 5B, the outsole 145 may be disposed on the bottom surface 255 of the second midsole 130 primarily in the forefoot region 110 and the hindfoot region 114. The forefoot portion 510 of the outsole 145 may include a series of segments 515(1)-515(5) on the bottom surface 255 of the second midsole 140 proximate to the medial side 100 and the toe end 104 of the article of footwear 10. The first segment 515(1) of the forefoot portion 510 of the outsole 145 may be disposed not only on the medial side 100 of the bottom surface 255 of the second midsole 140, but also around the toe end 104 of the bottom surface 255 of the second midsole 140. The segments 515(1)-515(5) of the forefoot portion 510 of the outsole 145 may be placed in the illustrated locations so as to be aligned with the portion of the bottom surface 255 of the second midsole 140 that is most frequently used during the toe off phase of a typical walking or running gait. Furthermore, the hindfoot portion 520 may be disposed on the bottom surface 255 of the second midsole 140 around the heel end 106 and at least partially along the lateral side 102 of the article of footwear 10. The hindfoot portion 520 may be located, as illustrated in FIGS. 5A and 5B, so as to align with the portion of the bottom surface 255 of the second midsole 140 that would typically impact a support surface during the heel strike phase of a walking or running gait.

The outsole 145 may be constructed from a material that is durable and contains a durometer value greater than the first and second midsoles 130, 140. The outsole 145 may be formed of an elastomer such as rubber. In the embodiment illustrated, the rubber material of the outsole 145 may possess durometer value (on a type A scale) of approximately 55A. In other embodiments of the article of footwear 10, the outsole 145 may have durometer value that is greater or lesser than 55A.

As further illustrated in FIGS. 5A and 5B, the bottom 500 of the article of footwear 10 includes one or more apertures configured to generate an air exchange within the foot cavity during the gait cycle. In the illustrated embodiment, the sole structure 125 includes one or more forward or forefoot apertures or openings 530, one or more central or intermediate apertures or openings 540 disposed in the midfoot region 112, and one or more rearward or heel apertures or openings 550 disposed in the hindfoot region 114.

Figure 7A:
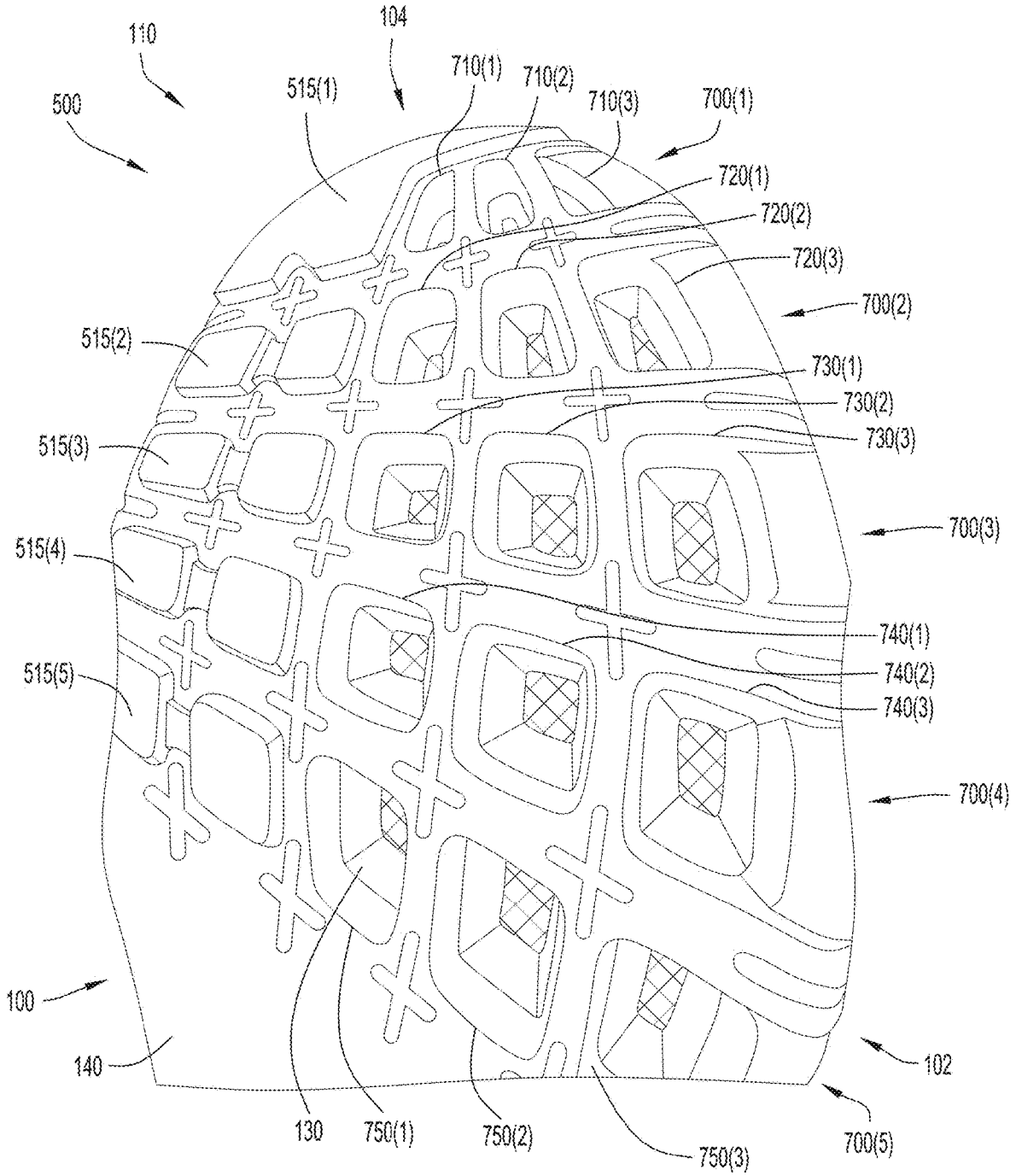
FIG. 7A illustrates a bottom view of the forefoot region of the embodiment of the article of footwear illustrated in FIG. 1.

The forward apertures or openings 530, disposed within the forefoot portion of the shoe, may include a plurality of openings arranged in an array spanning the transverse and longitudinal dimensions of the bottom 500. Specifically, the plurality of openings 530 includes five rows 700(1)-700(5) of openings. The first row 700(1) of openings is disposed proximate to the toe end 104, with the second row 700(2) of openings, the third row 700(3) of openings, the fourth row 700(4) of openings, and the fifth row 700(5) of openings disposed in succession along the lengthwise direction of the article of footwear 10 (i.e., from the toe end 104 towards the heel end 106). As illustrated in FIGS. 5A, 5B, and 7A, with the forefoot portion 510 of the outsole 145 being disposed in the bottom surface 255 of the second midsole 140 proximate to the medial side 100 of the article of footwear 10, the five rows 700(1)-700(5) of openings are disposed on the bottom surface 255 of the second midsole 140 proximate to the lateral side 102 of the article of footwear 10. As further illustrated, the first row 700(1) of openings may be at least partially aligned with the first segment 515(1) of the forefoot portion 510 of the outsole 145. Similarly, the second row 700(2) of openings may be aligned with the second segment 515(2) of the forefoot portion 510 of the outsole 145, while the third row 700(3) of openings may be aligned with the third segment 515(3) of the forefoot portion 510 of the outsole 145. The fourth row 700(4) of openings may also be aligned with the fourth segment 515(4) of the forefoot portion 510 of the outsole 145, while the fifth row 700(5) of openings may be aligned with the fifth segment 515(5) of the forefoot portion 510 of the outsole 145.

As further illustrated, the first row 700(1) may include three openings 710(1)-710(3), the second row 700(2) may include three openings 720(1)-720(3), and the third row 700(3) may include three openings 730(1)-730(3). In addition, the fourth row 700(4) may include three openings 740(1)-740(3), and the fifth row 700(5) may also include three openings 750(1)-750(3). Openings 710(1), 720(1), 730(1), 740(1), and 750(1) may be centrally aligned in the forefoot region 110 of the bottom surface 255 of the second midsole 140 in the lengthwise direction. Meanwhile, openings 710(3), 720(3), 730(3), 740(3), and 750(3) may be substantially aligned in the lengthwise direction along the lateral side 102 of the bottom surface 255 of the second midsole 140 in the forefoot region 110. It then follows that openings 710(2), 720(2), 730(2), 740(2), and 750(2) may be substantially aligned in the lengthwise direction between openings 710(1), 720(1), 730(1), 740(1), and 750(1) and openings 710(3), 720(3), 730(3), 740(3), and 750(3) on the bottom surface 255 of the second midsole 140 in the forefoot region 110. With this configuration, the openings 710(1)-710(3), 720(1)-720(3), 730(1)-730(3), 740(1)-740(3), 750(1)-750(3), and even the segments 515(1)-515(5) of the forefoot portion 510 of the outsole 145, are arranged in a grid or an array on the bottom surface 255 of the second midsole 140.

As illustrated, the openings 710(1)-710(3), 720(1)-720(3), 730(1)-730(3), 740(1)-740(3), 750(1)-750(3), may have a substantially rhombus or parallelogram shape. Alternatively, the openings may have any other suitable shapes (e.g., quadrilateral, rounded, multi-sided symmetrical or asymmetrical, etc.), where the shapes may be the same or different. Furthermore, the openings 710(1)-710(3), 720(1)-720(3), 730(1)-730(3), 740(1)-740(3), 750(1)-750(3), may increase in size both along the lengthwise direction (i.e., from the toe end 104 towards the heel end 106) and along the widthwise direction (i.e., from the medial side 100 towards the lateral side 102). Thus, opening 750(3) may be the largest of the openings 710(1)-710(3), 720(1)-720(3), 730(1)-730(3), 740(1)-740(3), 750(1)-750(3), while opening 710(1) may be the smallest of the openings 710(1)-710(3), 720(1)-720(3), 730(1)-730(3), 740(1)-740(3), 750(1)-750(3). In other embodiments, the number of openings 710(1)-710(3), 720(1)-720(3), 730(1)-730(3), 740(1)-740(3), 750(1)-750(3) and the number of rows 700(1)-700(5) may be greater or fewer than that illustrated in FIGS. 5A, 5B, and 7A.

Figure 7B:
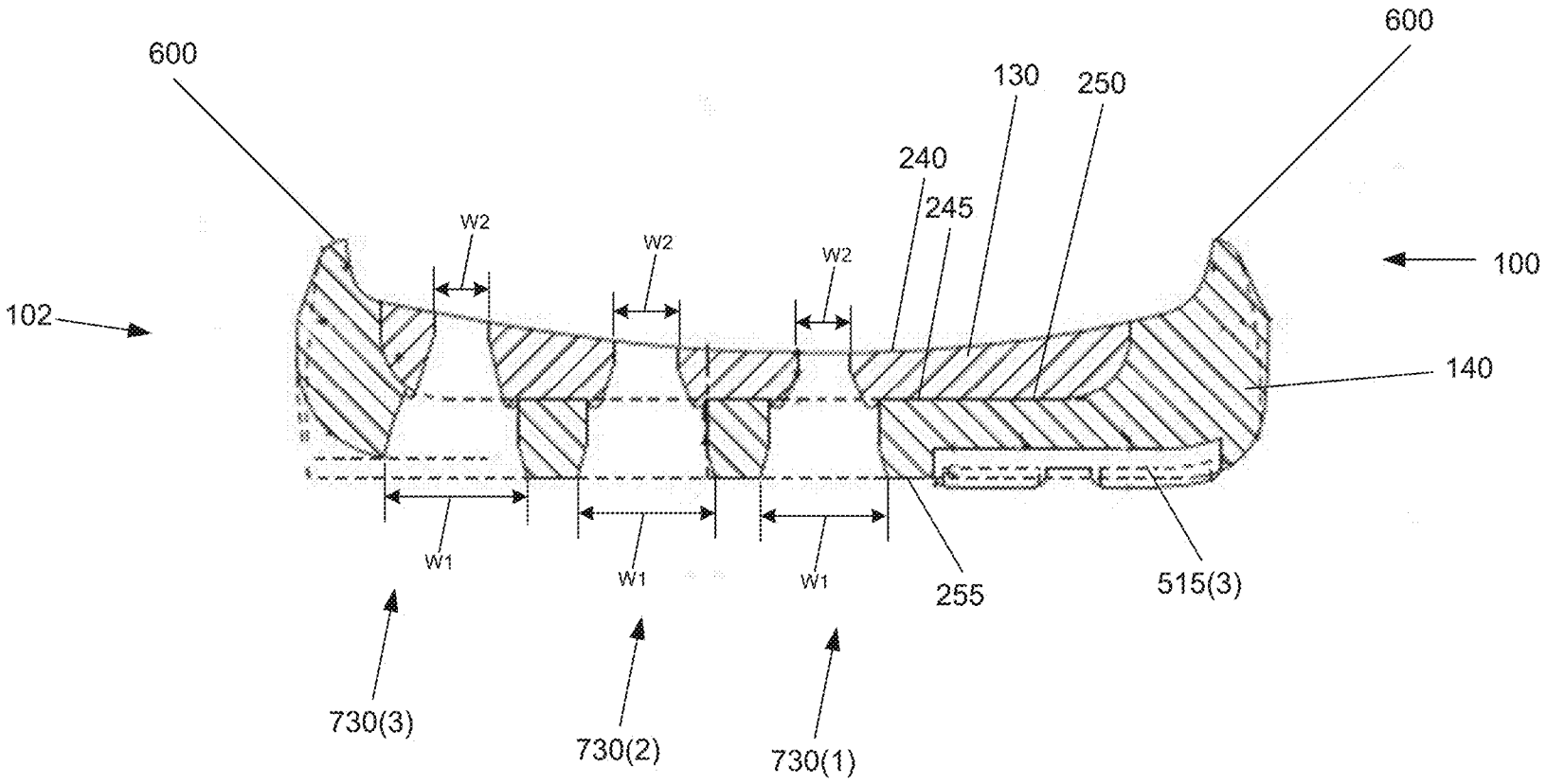
FIG. 7B illustrates a cross sectional view along line B-B of FIG. 5B of the forefoot region of the sole structure of the embodiment of the article of footwear illustrated in FIG. 1.

As best illustrated in FIG. 7B, the first row 700(1) of openings 710(1)-710(3) only extend through the second midsole 140, but do not extend through the first midsole 130. Conversely, the second, third, fourth, and fifth rows 700(2)-700(5) of openings 720(1)-720(3), 730(1)-730(3), 740(1)-740(3), 750(1)-750(3) extend through both the first midsole 130 and the second midsole 140. Each one of the openings 720(1)-720(3), 730(1)-730(3), 740(1)-740(3), 750(1)-750(3), however, is smaller in size through the first midsole 130 than through the second midsole 140. As best illustrated in FIG. 7B, the width W1 of each of the openings 730(1)-730(3) in the second midsole 140 is greater than the width W2 of each of the openings 730(1)-730(3). While FIG. 7B illustrates a cross sectional view that depicts the different widths W1, W2 of the openings 730(1)-730(3) through the first midsole 130 and the second midsole 140, the depiction of the different widths W1, W2 through the first and second midsoles 130, 140, respectively, also applies to each of the openings 720(1)-720(3), 740(1)-740(3), 750(1)-750(3).

The intermediate aperture or opening 540 is disposed rearward of the forward openings 530, being located within the midfoot region 112 of the bottom 500 of the article of footwear 10. As shown, the intermediate aperture includes an elongated opening 540 having a first end 800 and a second end 810 (e.g., rounded first and second ends). The elongated opening 540 is positioned such that the elongated opening 540 spans along the bottom surface 255 of the second midsole 140 in the lengthwise direction of the article of footwear 10. Thus, the first end 800 of the elongated opening 540 is disposed proximate the forefoot region 110 of the bottom 500 of the article of footwear 10, and the second end 810 of the elongated opening 540 is disposed proximate the hindfoot region 114 of the bottom 500 of the article of footwear 10.

The central aperture 540 may include a reinforcing element or frame 560 (also called a support member). In an embodiment, the reinforcing element 560 is a generally annular ring including a flange extending radially outward from ring outer surface. As illustrated in FIGS. 5B, 6, 8A, and 8B, the reinforcing element spans the midsoles 130, 140, with the flange being disposed between the bottom surface 245 of the first midsole 130 and the top surface 250 of the second midsole 140. With this configuration, the support member 560 possesses a T-shaped cross section, with a horizontal extension 610 (the flange) and a vertical extension 620 (the ring wall) that crosses over the horizontal extension 610. The horizontal extension 610 is primarily disposed between the bottom surface 245 of the first midsole 130 and the top surface 250 of the second midsole 140, while the vertical extension 620 may be disposed at least partially within the elongated opening 540 such that the vertical extension 620 is aligned with, and forms a portion of, the sidewall of the elongated opening 540. The support member 560 may be formed of rigid and/or non-foamed elastomer such as a thermoplastic elastomer (TPE). In an embodiment, the support member 560 is formed of a thermoplastic polyurethane (TPU) with a durometer value on (a type D scale) of approximately 70D. Thus, the support member 560 is substantially harder than the first and second midsoles 130, 140. In other embodiments of the article of footwear 10, the support member 560 may have durometer value that is greater or lesser than 70D. The support member 560 is configured to provide additional support to the midfoot region 112, providing torsional rigidity and preventing hyperextension of the article of footwear 10 and a foot disposed within the upper 120 of the article of footwear 10.

The first midsole 130 includes a plurality of widthwise extending bars 630(1)-630(5) that extend across the elongated opening 540. The widthwise extending bars 630(1)-630(5), along with the first end 800 and second end 810, define a series of six slots 640(1)-640(6) aligned, and in fluid communication, with the portion of the elongated opening 540 spanning through the second midsole 140. Because the first slot 640(1) may be defined by the first end 800 of the elongated opening 540 and the first extending bar 630(1), and because the sixth slot 640(6) may be defined by the second end 810 and the fifth extending bar 630(5), the first and sixth slots 640(1), 640(6) may be larger than the other slots 640(2)-640(5). In addition, the first and sixth slots 640(1), 640(6) may be partially rounded, while the remaining slots 640(2)-640(5) may be substantially rectangular. Other embodiments of the article of footwear may contain greater or fewer than the number of extending bars 630(1)-630(5) and the number of slots 640(1)-640(6) illustrated in FIGS. 5A, 5B, 6, and 8A. In addition, other embodiments of the article of footwear may contain slots 640(1)-640(6) of differing shapes from that illustrated in FIGS. 5A, 5B, 6, and 8A.

Figure 8A:
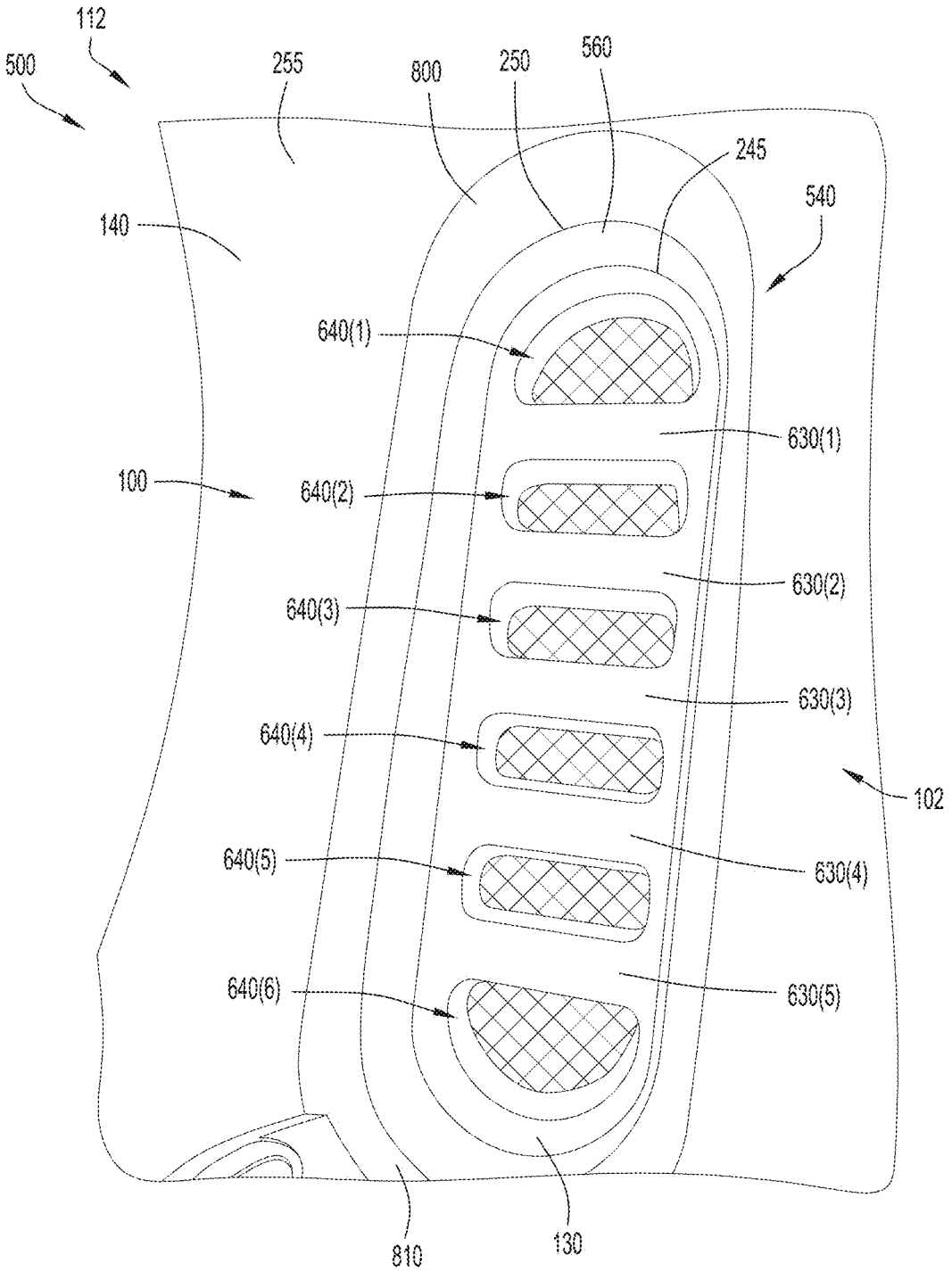
FIG. 8A illustrates a bottom view of the midfoot region of the embodiment of the article of footwear illustrated in FIG. 1.
Figure 8B:
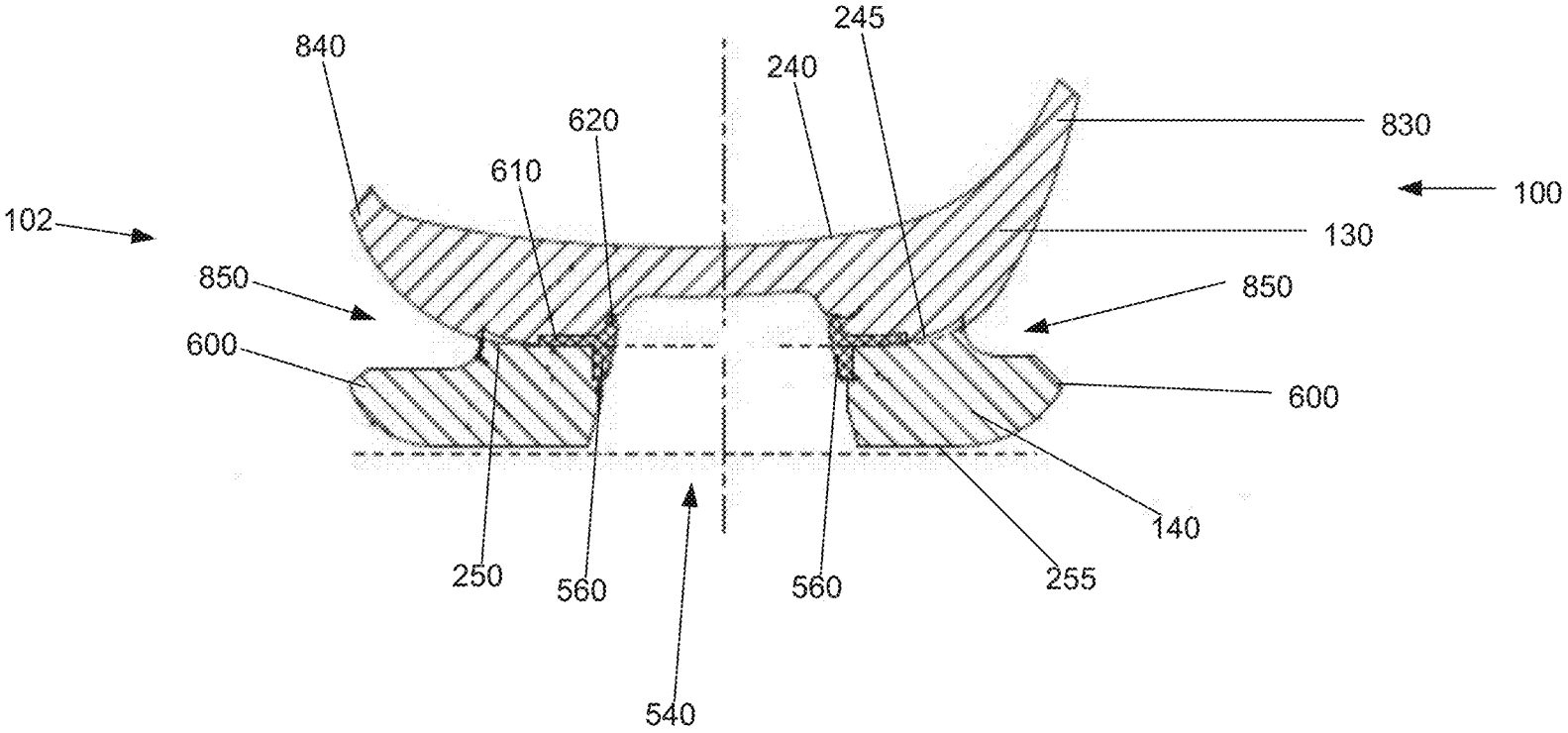
FIG. 8B illustrates a cross sectional view along line C-C of FIG. 5B of the midfoot region of the sole structure of the embodiment of the article of footwear illustrated in FIG. 1.

As explained above, the first midsole 130 may be exposed on the medial and lateral sides 100, 102 of the article of footwear 10 proximate to the middle portion 112. As illustrated in FIG. 8B, the upper edges 600 of the second midsole 140 do not extend upward past the top surface 240 of the first midsole 130, like that illustrated in FIGS. 6 and 7B. Instead, first midsole 130 contains a medial side extension 830 and a lateral side extension 840 that extend upward and around a portion of the upper 120. As explained briefly above, the medial side extension 830 and the lateral side extension 840 are configured to provide arch support to a foot disposed within the upper 120, but may be configured to still flex and/or bend when imparted with enough pressure/force. Thus, because the arch of a foot is typically highest on the medial side of the foot when compared to the lateral side of a foot, the medial side extension 830 extends upward a farther distance than the lateral extension 840.

As further illustrated in FIG. 8B, disposed between the upper edges 600 of the second midsole 140 and the medial and lateral side extensions 830, 840 are gaps 850. The gaps 850 enable the medial and lateral side extensions 830, 840 to bend and flex more easily compared to the portions of the first midsole 130 that are in direct contact with the second midsole 140. Thus, the gaps 850 enable the medial and lateral side extensions 830, 840 to move and contour to the arch of a foot disposed within the upper 120 of the article of footwear 10 as the article of footwear 10 is used.

Figure 9A:
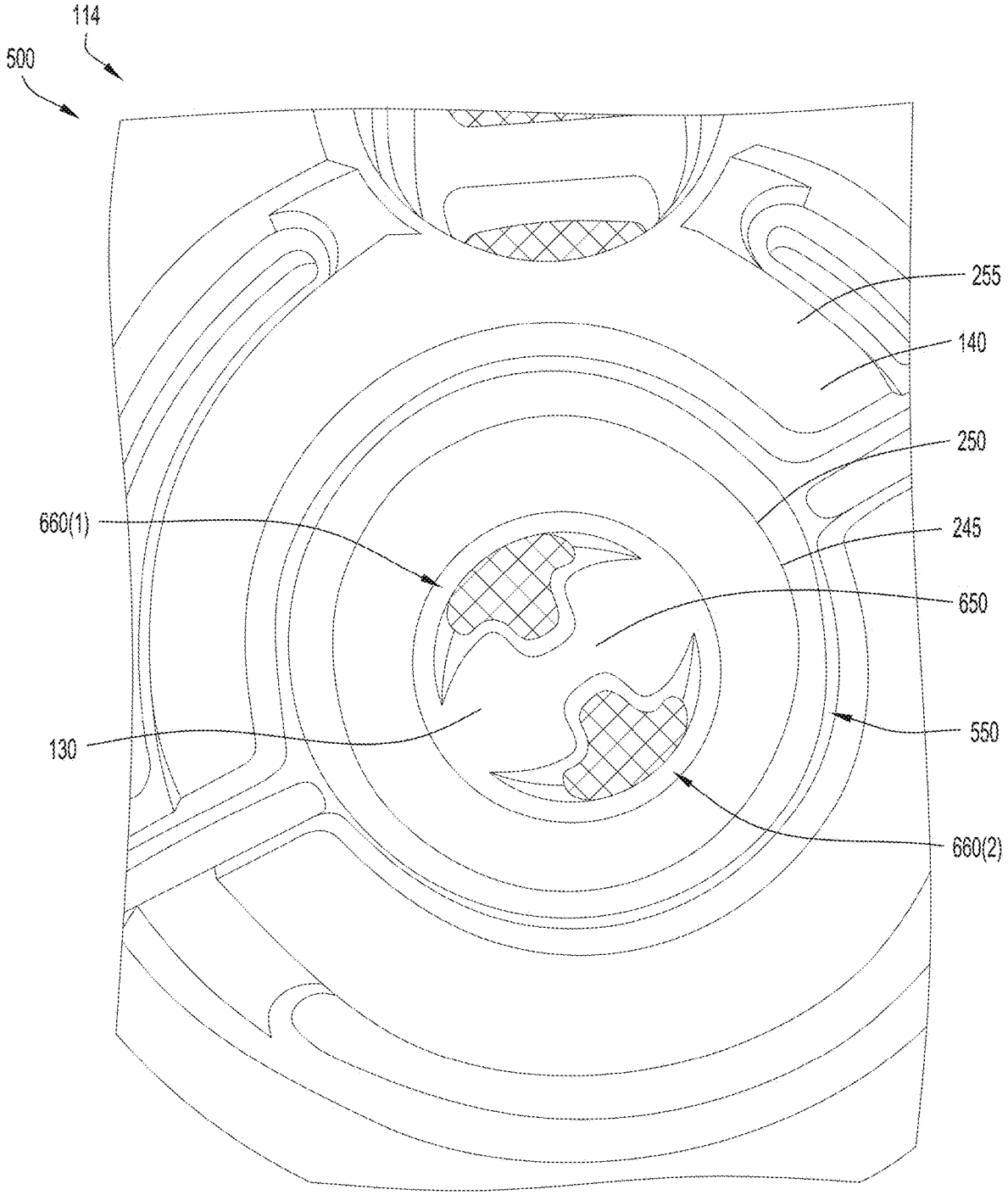
FIG. 9A illustrates a bottom view of the hindfoot region of the midsole of the embodiment of the article of footwear illustrated in FIG. 1.
Figure 9B:
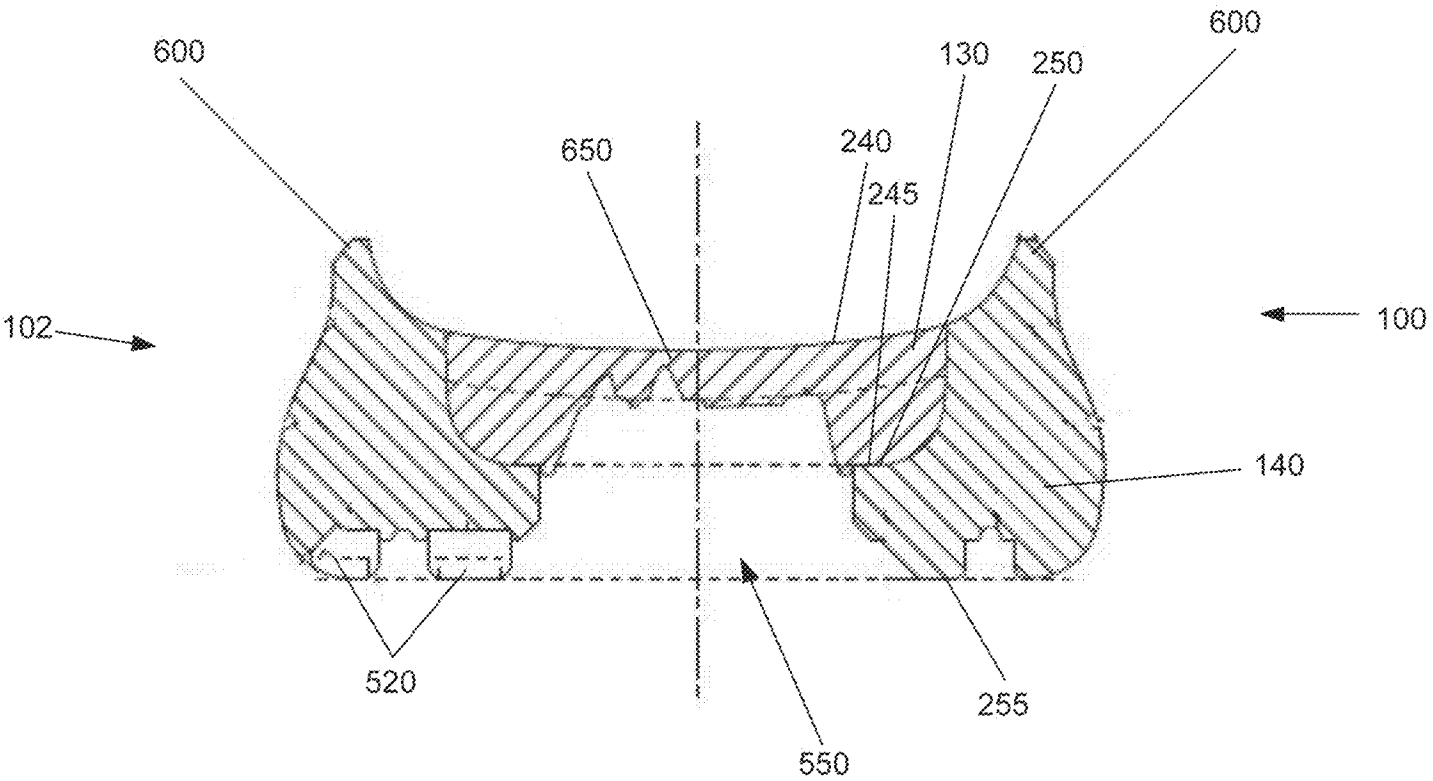
FIG. 9B illustrates a cross sectional view along line D-D of FIG. 5B of the hindfoot region of the sole structure of the embodiment of the article of footwear illustrated in FIG. 1.

The rearward aperture 550 is centrally located within the hindfoot region 114 of the bottom 500 of the article of footwear 10 such that the opening is generally aligned with the heel of the foot. In the illustrated embodiment, the rearward aperture 550 is a generally circular with a partition 650 (formed by first midsole 130) that extends across the diameter of the circular opening 550 to define a first aperture 660(1) and a second aperture 660(2) in fluid communication with the circular opening 550. Because of the shape of the partition 650, the apertures 660(1), 660(2) may be T-shaped. In other embodiments, however, the partition 650 and the apertures 660(1), 660(2) may be any other shape. While only one partition 650 is illustrated in FIGS. 6A, 9A, and 9B, the circular opening 550 may contain multiple partitions, and thus more apertures, or may contain no partition at all.

Figure 10A:
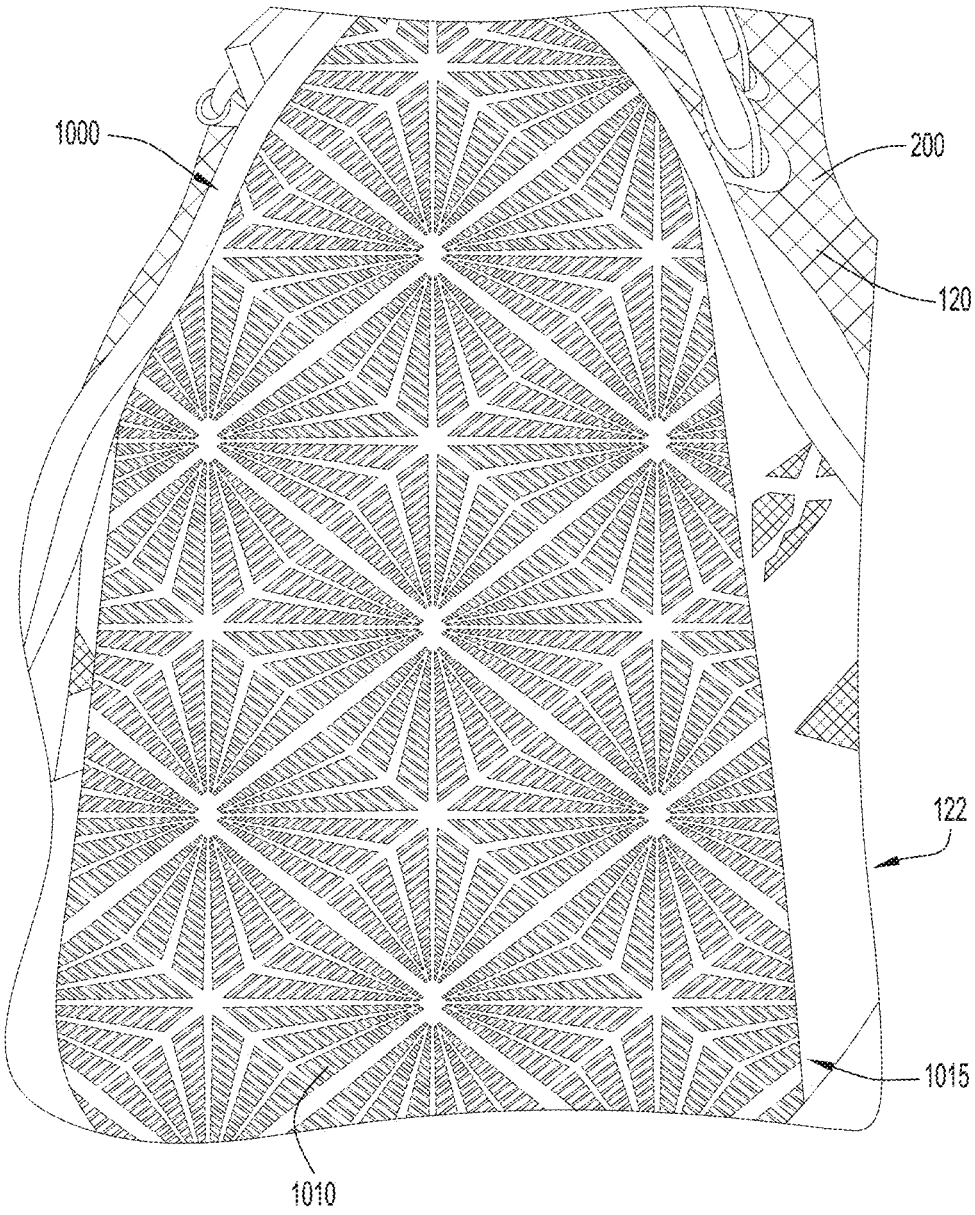
FIG. 10A illustrates an interior of the embodiment of the article of footwear illustrated in FIG. 1.
Figure 10B:
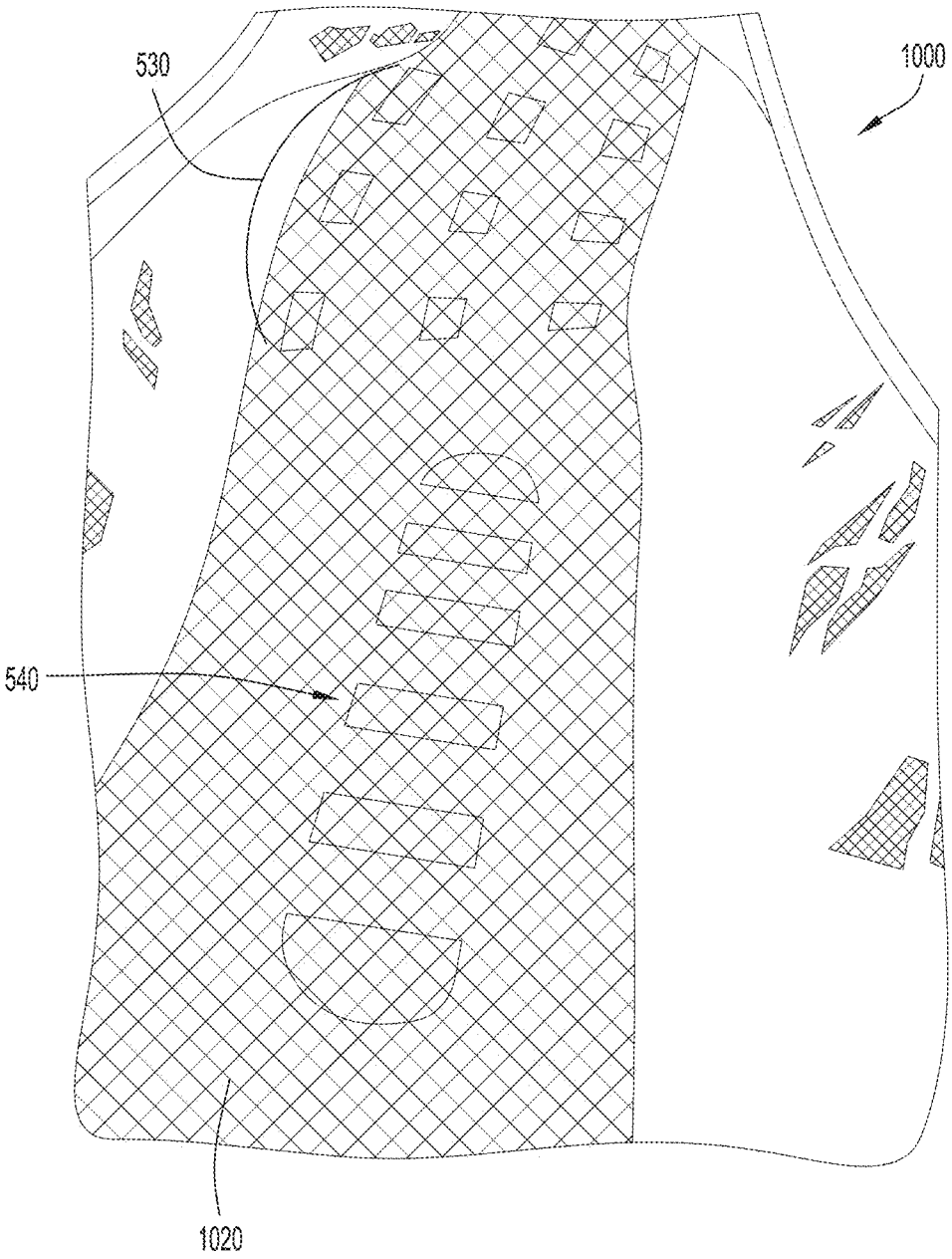
FIG. 10B illustrates the interior of the embodiment of the article of footwear illustrated in FIG. 10A with the insole removed.
Figure 10C:
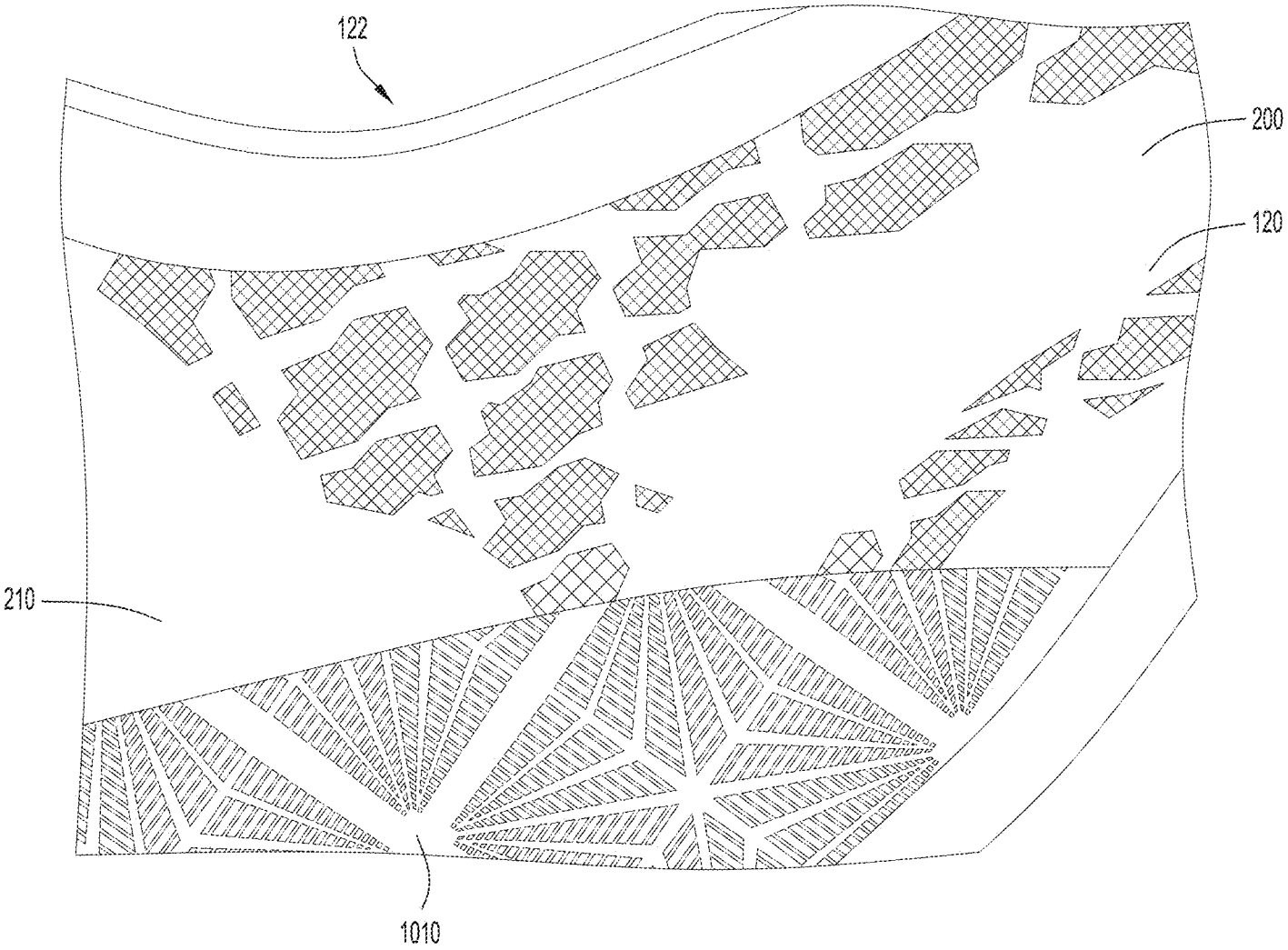
FIG. 10C illustrates a sidewall of the interior of the embodiment of the article of footwear illustrated in FIG. 10A.

Turning to FIGS. 10A, 10B, and 10C, the interior 1000 of the upper 120 includes a footbed 1020 and an insole 1010 positioned on the footbed 1020. The footbed 1020 includes a perforated strobel. In an embodiment, the strobel is a mesh textile (e.g., a single layer screen or monomesh). The insole, moreover, may be perforated, including a series of channels or apertures extending from the insole top surface to the insole bottom surface. The insole is formed of compression material such as ethylene vinyl acetate foam.

With this configuration, the foot cavity (i.e., the upper interior 1000) is in fluid communication with the ambient environment. Specifically, air may travel through an aperture 530, 540, 550, through the perforated strobel, and into the foot cavity via the apertures of the perforated insole (discussed in greater detail, below).

A thermal effect or regulation membrane or layer may be disposed on the interior surface of the upper (the liner) and/or the foot-facing surface of the insole 1010. The thermal effect membrane is a layer (e.g., a discontinuous layer) configured to interact with heat and/or moisture present with in the foot cavity, and/or to moderate or modulate the temperature and/or humidity within the foot cavity. The thermal effect membrane contains one or more system reactive components. By system reactive, it is intended to mean a compound that reacts to environmental conditions within a system. That is, the system reactive materials are selectively engaged in response to conditions of a wearer wearing the article of footwear 10. In particular, the compound absorbs, directs, and/or mitigates fluid (heat or water) depending on existing system conditions. For example, a component may initiate an endothermic reaction (e.g., when exposed to water). By way of further example, a component may be capable of selectively absorbing and releasing thermal energy (heat). By way of still further example, a component may be capable or conducting and/or directing heat from one location to another location within a system.

In an embodiment, the system reactive components include a cooling agent, a latent heat agent, and/or a heat dissipation agent. The cooling agent is an endothermic cooling agent (i.e., it creates a system that absorbs heat). Specifically, the cooling agent generates an endothermic reaction in an aqueous solution, absorbing energy from its surroundings. Accordingly, the cooling agent possesses a negative heat of solution when dissolved in water. By way of example, the endothermic cooling agent possesses a heat of enthalpy in the range of −10 cal/g to −50 cal/g. In particular, the endothermic cooling agent possesses a heat of enthalpy in the range −20 cal/g to −40 cal/g. With this configuration, when the cooling agent is contacted by water (i.e., the sweat of the wearer), the cooling agent is capable of cooling (i.e., lowering the temperature of) the water.

The cooling agent may be a polyol. By way of example, the cooling agent includes one or more of erythritol, lactitol, maltitol, mannitol, sorbitol, and xylitol. In an embodiment, the cooling agent is selected from one or more of sorbitol, xylitol and erythritol. Sorbitol is a hexavalent sugar alcohol and is derived from the catalytic reduction of glucose. Xylitol is produced by catalytic hydrogenation of the pentahydric alcohol xylose. Erythritol is produced from glucose by fermentation with yeast. Crystalline xylitol is preferred. The cooling agent may be present in an amount of about 15 wt % to about 35 wt % (e.g., about 25 wt %).

The latent heat agent is capable of absorbing and releasing thermal energy from a system while maintaining a generally constant temperature. In an embodiment, the latent heat agent is a phase change material (PCM). Phase change materials possess the ability to change state (solid, liquid, or vapor) within a specified temperature range. PCMs absorb heat energy from the environment when exposed to a temperature beyond a threshold value, and release heat to the environment once the temperature falls below the threshold value. For example, when the PCM is a solid-liquid PCM, the material begins as a solid. As the temperature rises, the PCM absorbs heat, storing this energy and becoming liquefied. Conversely, when temperature falls, the PCM releases the stored heat energy and crystallizes or solidifies. The overall temperature of the PCM during the storage and release of heat remains generally constant.

The phase change material should possess good thermal conductivity (enabling it to store or release heat in a short amount of time), a high storage density (enabling it to store a sufficient amount of heat), and the ability to oscillate between solid-liquid phases for a predetermined amount of time. Additionally, the phase change material should melt and solidify at a narrow temperature range to ensure rapid thermal response.

Linear chain hydrocarbons are suitable for use as the phase change materials. Linear chain hydrocarbons having a melting point and crystallization point falling within approximately 10° C. to 40° C. (e.g., 15° C. to 35° C.) and a latent heat of approximately 175 to 250 J/g (e.g., 185 to 240 J/g) may be utilized. In particular, a paraffin linear chain hydrocarbon having 15-20 carbon atoms may be utilized. The melting and crystallization temperatures of paraffin linear chain hydrocarbons having 15-20 carbon atoms fall in the range from 10° C. to 37° C. and 12° C.-30° C., respectively. The phase transition temperature of linear chain hydrocarbons, moreover, is dependent on the number of carbon atoms in the chain. By selecting a chain with a specified number of carbon atoms, a material can be selected such that its phase transition temperature liquefies and solidifies within a specified temperature window. For example, the phase change material may be selected to change phase at a temperature near (e.g., 1° C.-5° C. above or below) the average skin temperature of a user (i.e., a human wearer of the footwear, e.g., 33° C.-34° C.). With this configuration, the phase change material begins to regulate temperature either upon placement of the footwear on the wearer or shortly after the wearer begins physical activity.

In an embodiment, the paraffin is encapsulated in a polymer shell. Encapsulation prevents leakage of the phase change material in its liquid phase, as well as protects the material during processing (e.g., application to the substrate) and during consumer use. The resulting microcapsules may possess a diameter of about 1 to about 500 μm. In an embodiment, the paraffin PCM is present in an amount of about 25 wt % to about 45 wt % (e.g., about 35 wt %).

The heat dissipation agent is effective to conduct heat and/or direct heat from one location to another location within the system (e.g., within the membranes and/or the substrate). In an embodiment, the heat dissipation agent possesses a high heat capacity, which determines how much the temperature of the agent will rise relative to the amount of heat applied. By way of example, the heat dissipation agent is a silicate mineral such as jade, e.g., nephrite, jadeite, or combinations thereof. The heat dissipation material may be present in an amount (dry formulation) of about 30 wt % to about 50 wt % (e.g., about 40 wt %).

The system reactive components are present with respect to each other in a ratio of approximately 1:1 to 1:2. By way of example, the ratio of temperature reactive components-cooling agent, latent heat agent, and heat dissipation agent—may be approximately 1:2:2, respectively. As indicated above, in system reactive component mixture, the cooling agent is present in an amount of from 15 wt % to 35 wt %; the latent heat agent is present in an amount of from 25 wt % to 45 wt %. Similarly, the heat dissipation agent is present in an amount of from 25 wt % to 45 wt %.

In addition to the temperature reactive components, the thermal effect membrane further includes a binder effective to disperse the temperature reactive components and/or to adhere the temperature reactive components to the substrate (e.g., to the yarns/fibers forming these structures). The binder may be an elastomeric material possessing good elongation and tensile strength properties. Elastomeric materials typically have chains with high flexibility and low intermolecular interactions and either physical or chemical crosslinks to prevent flow of chains past one another when a material is stressed. In an embodiment, polyurethane (e.g., thermoplastic polyurethane such as polyester-based polyurethane) is utilized as the binder. In other embodiments, block copolymers with hard and soft segments may be utilized. For example, styrenic block copolymers such as a styrene-ethylene/butylene-styrene (SEBS) block copolymer may be utilized.

The thermal effect membrane may be applied to the substrate (the upper lining or the insole face) in any manner that maintains the integrity of the components and preserves properties of the substrate. In an embodiment, the thermal effect membrane is applied as a composition transferred to the substrate via printing process. By way of example, the composition is transferred via a rotogravure apparatus. In an embodiment, the comfort regulation composition includes about 20 wt % system reactive components (the cooling agent, the latent heat agent, and the phase change material), 30 wt % binder, and about 50 wt % solvent (aqueous or non-aqueous (e.g., methyl ethyl ketone)). In other embodiments, the thermal effect composition may further include pigments or other additives such as surfactants.

Figure 11:
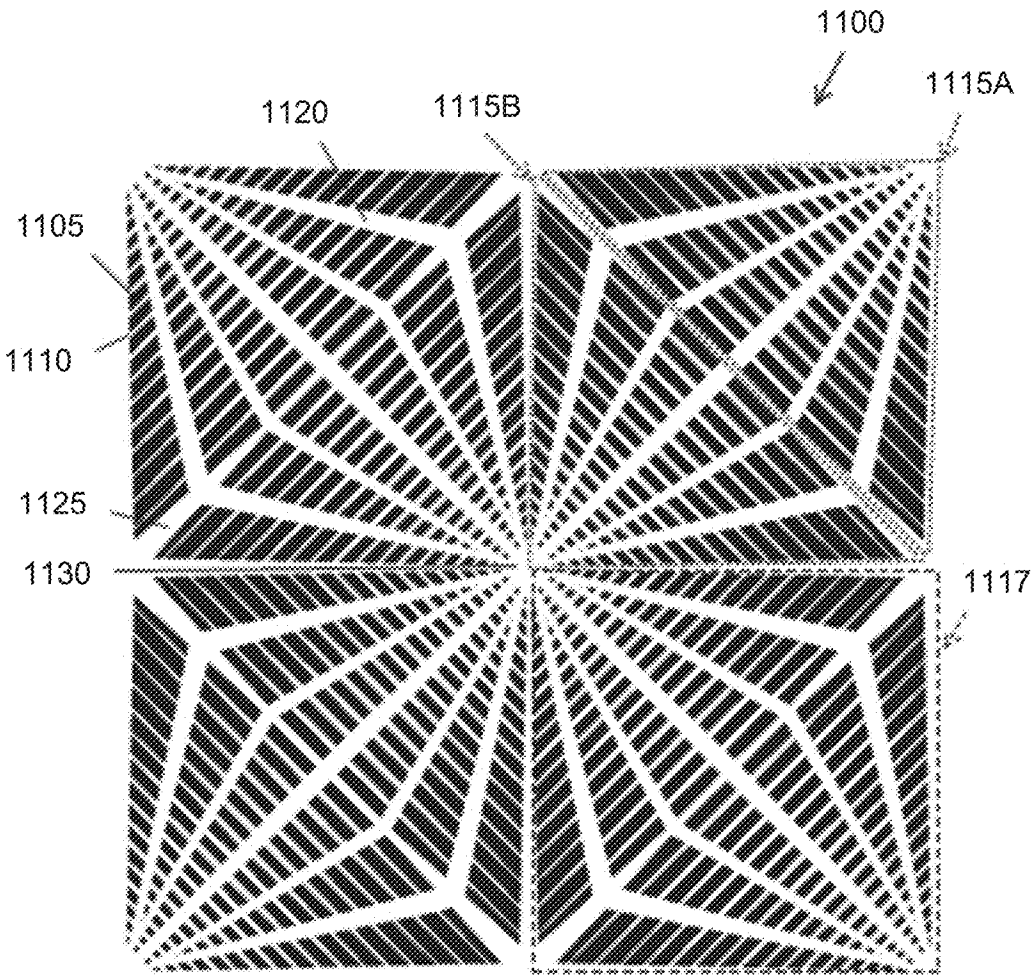
FIG. 11 illustrates an application pattern of the thermal effect membrane in accordance with an embodiment of the invention.

The thermal effect membrane may be applied in a repeating pattern 1015 of units. Referring to FIG. 11, each unit 1100 includes generally linear elements 1105 oriented in spaced relationship from each other, being separated by element channels 1110 such that adjacent elements are oriented generally parallel to each other. The dimensions of each linear member 1105 and channel 1110 may be any suitable for its described purpose. The linear members 1105 are organized such that a discontinuous array of elements spans the substrate surface. In the illustrated embodiment, the linear members 1105 are organized such that they cooperate to define a first or outer triangular section 1115A and a second or inner triangular section 1115B. The first triangular section 1115A is a mirror image of the second triangular section 1115B, and vice versa. The triangle sections 1115A, 1115B, in turn, cooperate to define a quadrant or substructure 1117 of the unit 1100. Each quadrant 1117 is intersected by one or more (e.g., five) radial channels 1120, as well as a segment channel 1125 that separates the first triangle section 1115A from the second triangle section 1115B. The radial 1120 and segment 1125 channels may possess a wider transverse dimension than the element channels 1110. The substructures 1110, moreover, cooperate to define a central aperture 1130 disposed the center of the structure 1100.

Figure 12:
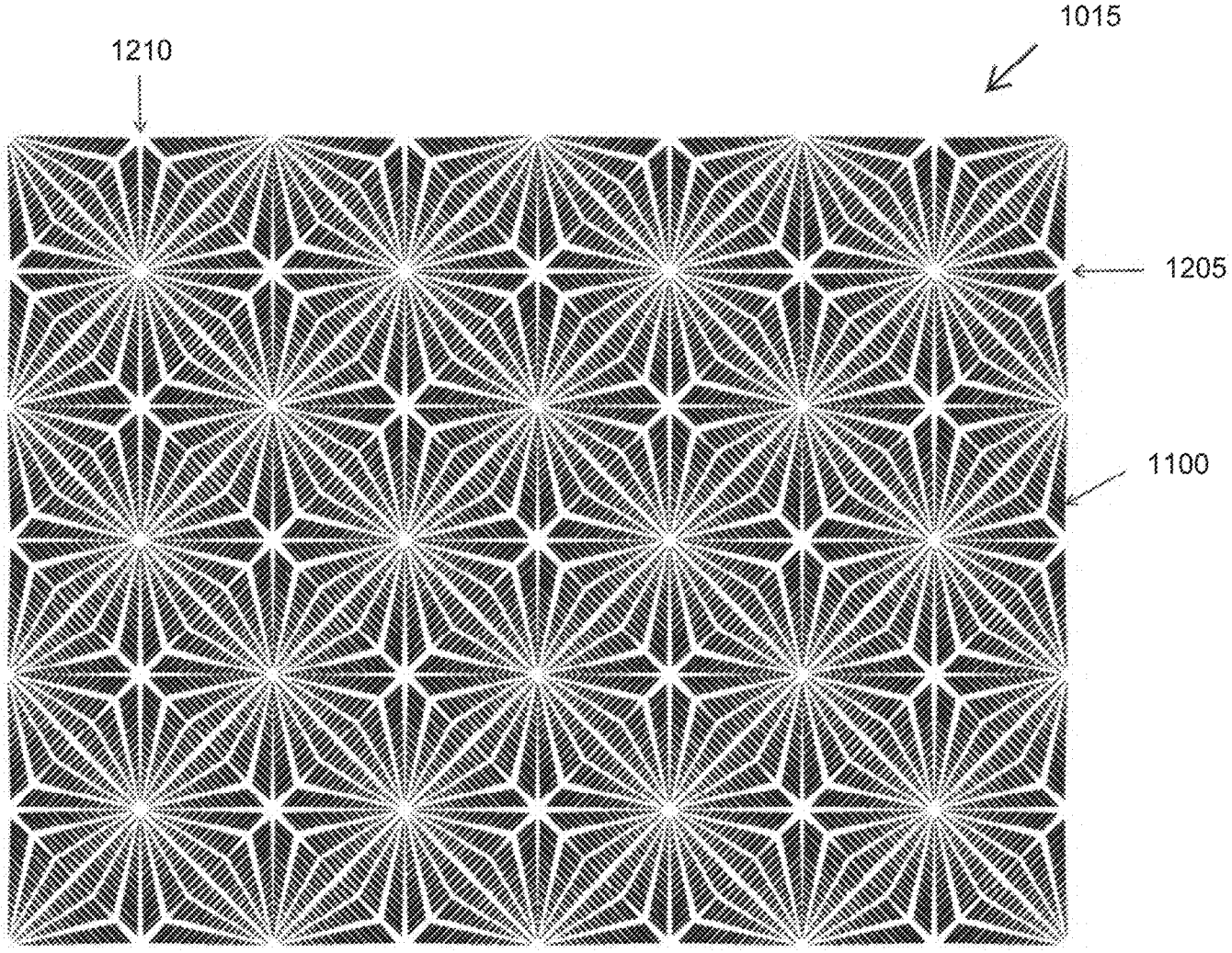
FIG. 12 illustrates the application pattern of FIG. 11, shown in an array.

Referring to FIG. 12, a plurality of units 1100 are disposed adjacent each other to form a pattern 215, 1015 on the substrate. Specifically, the units 1100 are oriented in rows 1205 and columns 1210 along the substrate such that a network of interconnecting channels is formed. With this configuration, the linear members 1105 represent areas along the substrate including (covered by) the thermal effect membranes. The channels 1110, 1120, 1125 and apertures 1130 in contrast, define areas free (e.g., substantially free) of the thermal effect membranes. The areas covered by the thermal effect membranes modify the properties of the substrate by providing increased (improved) temperature regulation properties to the substrate (compared to an area free of membrane). The substrate properties in the areas free of the thermal effect membrane, in contrast, are not modified. This creates a bimodal surface in which the properties of the substrate (e.g., air permeability, vapor transmission, etc.) and the properties of the membranes cooperate to provide the article of footwear 10 with desired properties. Stated another way, the each unit 1100 of the pattern 1200 may include a ratio of free area to treated area falling within predetermined values. By way of example, the ratio of free area to covered area may be approximately 3:1 (i.e., the treated area covers approximately 30% of the substrate surface 115).

By way of further explanation, it is believed that composition and processing result in a porous or semi-porous membrane including pores or pockets formed therein. That is, the high ratio of system reactive component particles to binder—as well as the compression of the membranes into the substrates—may create fissure, pores, or cavities within the membranes. These pores/cavities may be effective to transporting water within the system. Specifically, the membranes may transport water away from the skin of the wearer and into the pores/cavities, where one or more of the system reactive components are located. Thus, when fluid is drawn toward the cooling agent, the agent may absorb water to generate the endothermic reaction. Alternatively, the water may become trapped in a cavity within the membranes, or pass completely through the membranes to the substrate. Accordingly, in addition to tempering the temperature within the system, the membranes further improve the overall moisture management capacity of the substrates compared to an untreated substrate.

The resulting thermal effect layer is effective to improve the thermal comfort of a wearer. In particular, the thermal effect layer is effective to either delay the increase of temperature within the foot cavity and/or maintain the cavity temperature at a lower value compared to a foot cavity lacking the thermal effect layer.

By equipping an article of footwear with an upper 120 having a thermal effect layer and/or equipping a sole structure containing apertures 530, 540, 550 that promote airflow into the interior 1000 of the upper 120, the article of footwear 10 provides improved temperature and/or moisture management properties compared to footwear lacking the one or both of the sole apertures or thermal effect layer. In operation, the sole apertures 530, 540, 550 enable an exchange of airflow at various stages within a user's gait cycle. A typical gait cycle for running or walking begins with a "heel strike" and ends with a "toe-off" That is, during the first phase of the gait cycle, the heel of the foot contacts the ground (heel strike). At the second phase, the foot rotates forward until the arch of the foot contacts the ground (midfoot strike). At the third phase, foot rotation continues until the forefoot contacts the ground (forefoot strike). In the final phase, after forefoot contact, rotation again continues until the toes are lifted off of the ground (toe-off). Thus, as the article of footwear moves through the gait cycle, air pressure generated by contact with the ground forces an exchange air along each of the hindfoot, midfoot, and forefoot areas of the shoe.

Specifically, at heel strike, the downward movement of the heel towards the ground forces air through the rearward aperture 550. This, in turn, causes an air exchange, with the heated air within the cavity being displaced by the air entering via the aperture. Similarly, at midfoot strike, air is again forced into the foot cavity via intermediate aperture 540, displacing heated air out of the cavity, replacing with air at ambient conditions. Finally, at forefoot strike, ambient air is forced into the cavity via the forward apertures 530, displacing heated air from the foot cavity. As the article of footwear 10 is swung upward and forward, air is forced into the interior 1000 of the upper 120 through the porous material of the first portion 200 of the upper 120. Air from the cavity may exit via the sole apertures 530, 540, 550 or the open web structure of the upper.

In addition, the thermal effect layer applied to the interior surface of the upper may be selectively engaged, depending on conditions present within the upper (e.g., within the shoe cavity). Initially, the latent heat agent (the phase change material) absorbs heat generated by the foot, delaying an increase of temperature within the foot cavity. Additionally, the heat dissipation agent rapidly absorbs heat from the foot cavity, moving it through the thermal effect layer toward the outer shell of the upper (away from the foot and/or into the ambient environment). Finally, as moisture within the foot cavity increases (e.g., sweating occurs), the cooling agent is engaged, generating an endothermic reaction.

As previously explained, airflow into the interior 1000 of the upper 120 is also increased by the mesh-like first portion 200 of the upper 120. This increased airflow, by the mesh-like material of the first portion of the upper 120, the footbed 120, and the multiple openings 530, 540, 550, increases the effectiveness of the thermal effect membranes to delay the increase of skin temperature and/or maintain the skin temperature at a lower value. The airflow into the interior 1000 of the upper 120 through the multiple openings 530, 540, 550 may activate the thermal effect membranes to regulate the temperature and moisture capacity of the substrate. The airflow through the multiple openings 530, 540, 550 and into the interior 1000 of the upper 120 may also recharge the thermal effect membranes to further allow the membranes to continue to regulate the temperature and manage the moisture capacity of the substrate.

In addition, the airflow entering the shoe cavity acts to recharge the thermal effect membrane, e.g., permitting the phase change material to release heat while evaporating condensation from the cavity, moving the water vapor out of the shoe (e.g., to recharge the xylitol).

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of footwear defining a forefoot region with a toe end, a midfoot region, and a hindfoot region with a heel end, the article of footwear comprising:

an upper extending from the toe end to the heel end and defining a heel, a medial quarter, a lateral quarter, a vamp and a toe cage, the upper comprising an outer shell and an inner lining, the inner lining defining a continuous surface;

a mesh footbed comprising a mesh material extending from the hindfoot region to the forefoot region, the footbed and upper forming a foot cavity operable to house a foot of a wearer;

an insole disposed within the foot cavity and over and in contact with the mesh footbed;

a discontinuous print layer applied to each of the insole and the inner lining of the upper, the discontinuous print layer comprising a plurality of system reactive components selectively engaged in response to conditions present within the foot cavity; and a sole structure oriented below the mesh footbed, the sole structure comprising a first midsole and a second midsole, wherein:

the first midsole includes a plurality of first openings extending through the first midsole, the second midsole includes a plurality of second openings extending through the second midsole; and each first opening is aligned with a corresponding second opening to form a combined opening that extends through the sole structure to the mesh footbed such that the mesh material of the mesh footbed is visible through each combined opening at a bottom exterior surface of the sole structure and the sole structure is configured to permit airflow into the foot cavity that is effective to recharge a system reactive component within the discontinuous print layer;

wherein the second midsole includes further openings that extend through the second midsole and that do not align with any first opening in the first midsole.

2. The article of footwear according to claim 1, wherein the first midsole has a first durometer value and the second midsole has a second durometer value, the second durometer value being greater than the first durometer value.

3. The article of footwear according to claim 2, wherein the combined openings in the sole structure further comprise:

a plurality of forefoot openings disposed in an array in the forefoot region;

a midfoot opening disposed within the midfoot region of the article of footwear; and a heel aperture disposed in the hindfoot region of the article of footwear.

4. The article of footwear according to claim 3, wherein the insole further comprises perforations to permit passage of air therethrough, and wherein the mesh footbed, the perforations of the insole, and at least one of the plurality of forefoot openings, the midfoot opening, and the heel aperture cooperate to permit the airflow into the foot cavity.

5. The article of footwear according to claim 3, wherein the sole structure further comprises a reinforcement member disposed within the midfoot opening between the first midsole and the second midsole.

6. The article of footwear according to claim 1, wherein the discontinuous print layer is porous.

7. The article of footwear according to claim 1, wherein the plurality of system reactive components includes a cooling agent, a latent heat agent, and a heat dissipation agent, and wherein:

the cooling agent is a polyol selected from the group consisting of sorbitol, xylitol, and erythritol; and the latent heat agent is a phase change material comprising a paraffinic hydrocarbon.

8. The article of footwear according to claim 7, wherein the discontinuous print layer:

defines free areas and covered areas; and further comprises a binder effective to disperse the system reactive components and to adhere the system reactive components to the insole and the inner lining.

9. The article of footwear according to claim 1, wherein the outer shell is an open web defining apertures.

10. The article of footwear according to claim 1, further comprising a medial set of eyelets and a lateral set of eyelets, each eyelet capable of receiving a lacing element.

11. The article of footwear of claim 1, wherein the mesh footbed consists of the mesh material.

12. The article of footwear of claim 1, wherein each first opening includes a first width, each second opening includes a second width, and the second width is greater than the first width.

13. The article of footwear of claim 1, wherein the sole structure further comprises an outsole secured to an exterior surface of the second midsole.

14. An article of footwear including a foot cavity, the article of footwear comprising:

an upper including an exterior layer and interior layer, the interior layer positioned within the foot cavity;

a footbed comprising a screen;

a perforated insole disposed within the foot cavity on and in contact with the footbed, the insole including a first, user-facing surface and a second surface;

a thermal effect print configured to regulate temperature within the foot cavity applied to the first surface of the insole, the thermal effect print comprising a plurality of system reactive components, the system reactive components being selectively engaged in response to conditions present within the foot cavity; and a sole structure coupled to the upper and positioned below the footbed, the sole structure comprising a first midsole and a second midsole, wherein:

the first midsole includes a plurality of first openings extending through the first midsole and located at a forefoot region, a midfoot region and a hindfoot region of the sole structure, the second midsole includes a plurality of second openings extending through the second midsole and located at the forefoot region, the midfoot region and the hindfoot region of the sole structure;

each first opening is aligned with a corresponding second opening to form a combined opening that is, in fluid communication with the foot cavity, and wherein airflow into the foot cavity via each combined opening is effective to recharge the thermal effect print; and each combined opening extends through the sole structure to the footbed such that the screen of the footbed is visible from each combined opening in the sole structure at a bottom exterior surface of the sole structures;

wherein at least some of the second openings extending through the second midsole do not align with any first opening in the first midsole.

15. The article of footwear according to claim 14, wherein the first midsole has a first durometer value and the second midsole has a second durometer value, and the second durometer value is greater than the first durometer value.

16. The article of footwear according to claim 14, wherein the plurality of system reactive components includes a cooling agent, a latent heat agent, and a heat dissipation agent.

17. The article of footwear according to claim 16, wherein:

the cooling agent is a polyol selected from the group consisting of sorbitol, xylitol, and erythritol; and the latent heat agent is a phase change material comprising a paraffinic hydrocarbon.

18. The article of footwear according to claim 14, wherein:

the exterior layer of the upper comprises an open web with apertures:

the interior layer comprises a lining defining a continuous surface operable to receive the thermal effect print; and the article of footwear further comprises the thermal effect print applied to the continuous surface of the lining.

19. The article of footwear according to claim 14, further comprising medial eyelets and lateral eyelets, each eyelet capable of receiving a lacing element.

20. The article of footwear of claim 14, wherein each first opening includes a first width, each second opening includes a second width, and the second width is greater than the first width.

21. The article of footwear of claim 14, wherein the sole structure further comprises an outsole secured to an exterior surface of the second midsole.

* * * * *